US010655416B2

(12) United States Patent
Massey et al.

(10) Patent No.: US 10,655,416 B2
(45) Date of Patent: May 19, 2020

(54) DOWNHOLE APPARATUS FOR DISCONNECTING PORTIONS OF DOWNHOLE TOOL STRING

(71) Applicant: Impact Selector International, LLC, Houma, LA (US)

(72) Inventors: James Patrick Massey, Breckenridge, CO (US); Jason Allen Hradecky, Heath, TX (US)

(73) Assignee: Impact Selector International, LLC, Houma, LA (US)

( * ) Notice: Subject to any disclaimer, the term of this patent is extended or adjusted under 35 U.S.C. 154(b) by 31 days.

(21) Appl. No.: 16/004,405

(22) Filed: Jun. 10, 2018

(65) Prior Publication Data

US 2018/0363402 A1 Dec. 20, 2018

Related U.S. Application Data

(60) Provisional application No. 62/517,272, filed on Jun. 9, 2017.

(51) Int. Cl.
*E21B 23/00* (2006.01)
*E21B 31/107* (2006.01)
*E21B 31/113* (2006.01)

(52) U.S. Cl.
CPC ..... *E21B 31/1135* (2013.01)

(58) Field of Classification Search
CPC ..... E21B 17/02; E21B 23/00; E21B 31/107; E21B 31/1075
See application file for complete search history.

(56) References Cited

U.S. PATENT DOCUMENTS 5,509,481 A * 4/1996 Huber ..... E21B 23/04 166/297
6,082,457 A 7/2000 Best et al.
7,353,871 B2 * 4/2008 Hromas ..... E21B 17/06 166/297

(Continued)

FOREIGN PATENT DOCUMENTS

WO 2017087504 A1 5/2017

OTHER PUBLICATIONS

PCT/US2018/036940 International Search Report and Written Opinion dated Nov. 16, 2018, 12 pages.

*Primary Examiner* — Kenneth L Thompson
(74) *Attorney, Agent, or Firm* — Boisbrun Hofman, PLLC

(57) ABSTRACT

An apparatus and method for connecting and selectively disconnecting within a wellbore first and second portions of a downhole tool string from each other. The apparatus may be a downhole tool having a first connector sub connectable with the first portion of the downhole tool string, a second connector sub connectable with the second portion of the downhole tool string, an internal chamber, and a fastener connecting the first and second connector subs. At least a portion of the fastener fluidly separates the internal chamber into a first chamber portion and a second chamber portion. The first chamber portion is fluidly connected with the space external to the downhole tool. The downhole tool is selectively operable to disconnect the first and second connector subs from each other to disconnect the first and second portions of the downhole tool string from each other.

20 Claims, 7 Drawing Sheets

(56) References Cited

U.S. PATENT DOCUMENTS

| | | | | |
|---|---|---|---|---|
| 8,347,964 | B2 * | 1/2013 | Fisher | E21B 17/023 166/242.6 |
| 2002/0053434 | A1 | 5/2002 | Chen et al. | |
| 2012/0132439 | A1 * | 5/2012 | Ratcliffe | E21B 17/021 166/377 |
| 2018/0058154 | A1 * | 3/2018 | Kitchen | E21B 17/06 |
| 2018/0258724 | A1 * | 9/2018 | Massey | E21B 31/1075 |
| 2019/0203542 | A1 * | 7/2019 | Huxtable | E21B 17/023 |

* cited by examiner

DOWNHOLE APPARATUS FOR DISCONNECTING PORTIONS OF DOWNHOLE TOOL STRING

CROSS-REFERENCE TO RELATED APPLICATIONS

This application claims priority to and the benefit of U.S. Provisional Application No. 62/517,272, titled "DOWNHOLE APPARATUS," filed Jun. 9, 2017, the entire disclosure of which is hereby incorporated herein by reference.

BACKGROUND OF THE DISCLOSURE

Wells are generally drilled into a land surface or ocean bed to recover natural deposits of oil and gas, and other natural resources that are trapped in geological formations in the Earth's crust. Testing and evaluation of completed and partially finished well has become commonplace, such as to increase well production and return on investment. Information about the subsurface formations, such as measurements of the formation pressure, formation permeability, and recovery of formation fluid samples, may be useful for predicting the economic value, the production capacity, and production lifetime of a subsurface formation. Furthermore, intervention operations in completed wells, such as installation, removal, or replacement of various production equipment, may also be performed as part of well repair or maintenance operations or permanent abandonment. Such testing and intervention operations have become complicated as wellbores are drilled deeper and through more difficult materials. Consequently, in working with deeper and more complex wellbores, it has become more likely that downhole tools, tool strings, tubulars, and other downhole equipment may become stuck within the wellbore.

A downhole tool, such as an impact or jarring tool, may be utilized to dislodge a tool string or other equipment when it becomes stuck within a wellbore. The impact tool may be included as part of the tool string and deployed downhole or the impact tool may be deployed after the tool string becomes stuck. Tension may be applied from a wellsite surface to the deployed impact tool via a wireline or other conveyance means utilized to deploy the impact tool to generate elastic energy. After sufficient tension is applied, the impact tool may be triggered to release the elastic energy and deliver an impact intended to dislodge the stuck tool string.

If the impact tool is not able to dislodge the stuck tool string, a release tool included along the stuck tool string may be operated to disconnect a free portion of the tool string from a stuck portion of the tool string. The release tool may be operated, for example, by applying tension from the wellsite surface to break a shear pin to uncouple upper and lower portions of the release tool and, thus, the tool string from each other. After the free portion of the tool string is disconnected from the stuck portion, the free portion may be removed to the wellsite surface. Fishing equipment may then be conveyed downhole to couple with and retrieve the stuck portion of the tool string. However, in some downhole applications, such as in deviated wellbores or when multiple bends are present along the wellbore, friction between a sidewall of the wellbore and the conveyance means may reduce or prevent adequate tension from being applied to the tool string and the release tool therein to break the shear pin or otherwise uncouple and separate the upper and lower portions of the release tool and, thus, disconnect the free and stuck portions of the tool string from each other.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
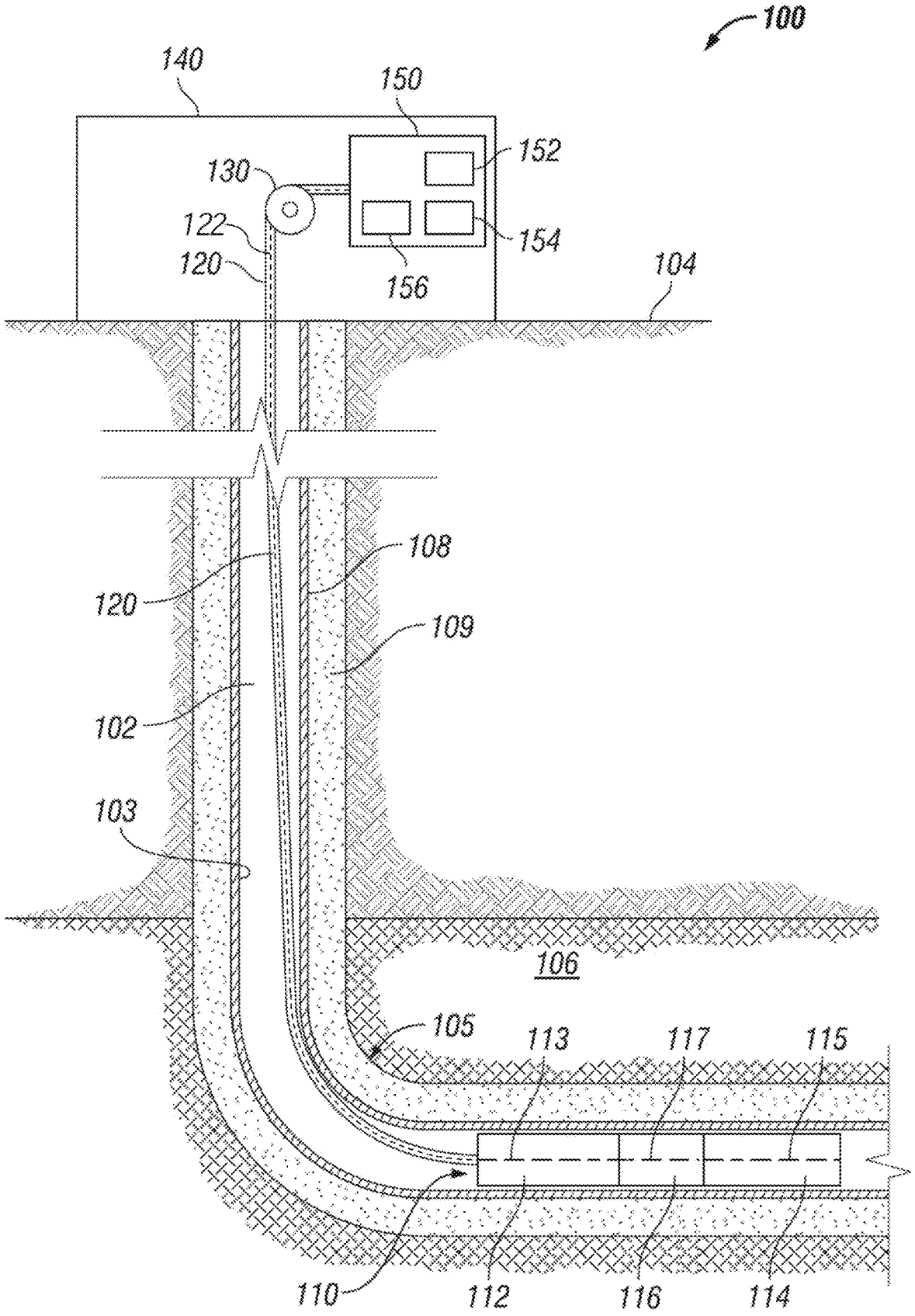
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite system 100 showing an example environment comprising or utilized in conjunction with a downhole tool string 110 according to one or more aspects of the present disclosure. The tool string 110 may be suspended within a wellbore 102 that extends from a wellsite surface 104 into one or more subterranean formations 106. The wellbore 102 may be a cased-hole implementation comprising a casing 108 secured by cement 109. However, one or more aspects of the present disclosure are also applicable to and/or readily adaptable for utilizing in open-hole implementations lacking the casing 108 and cement 109. The tool string 110 may be suspended within the wellbore 102 via a conveyance means 120 operably coupled with a tensioning device 130 and/or other surface equipment 140 disposed at the wellsite surface 104.

The tensioning device 130 may apply an adjustable tensile force to the tool string 110 via the conveyance means 120 to convey the tool string 110 along the wellbore 102. The tensioning device 130 may be, comprise, or form at least a portion of a crane, a winch, a draw-works, an injector, a top drive, and/or another lifting device coupled to the tool string 110 via the conveyance means 120. The conveyance means 120 may be or comprise a wireline, a slickline, a digital slickline, an e-line, coiled tubing, drill pipe, production tubing, and/or other conveyance means, and may comprise and/or be operable in conjunction with means for communication between the tool string 110, the tensioning device 130, and/or one or more other portions of the surface equipment 140, including a power and control system 150. The conveyance means 120 may comprise a multi-conductor wireline and/or other electrical conductor 122 extending between the tool string 110 and the surface equipment 140. The power and control system 150 may include a source of electrical power 152, a memory device 154, and a surface controller 156 operable to receive and process electrical signals from the tool string 110 and/or commands from a human wellsite operator.

The tool string 110 is shown suspended in a non-vertical portion of the wellbore 102 resulting in the conveyance means 120 coming into contact with a sidewall 103 of the wellbore 102 along a bend or deviation 105 in the wellbore 102. The contact may cause friction between the conveyance means 120 and the sidewall 103, such as may impede or reduce the tension being applied to the tool string 110 by the tensioning device 130. However, it is to be understood that the tool string 110 may be utilized within a vertical wellbore or a substantially vertical portion of the wellbore 102.

The tool string 110 may comprise an uphole (i.e., upper) portion 112, a downhole (i.e., lower) portion 114, and a release tool 116 coupled between and connecting the upper and lower tool string portions 112, 114. The release tool 116 may be selectively operable to uncouple, disconnect, part, or otherwise release the uphole portion 112 from the downhole portion 114 while conveyed within the wellbore 102. The uphole portion 112 of the tool string 110 may comprise at least one electrical conductor 113 in electrical communication with one or more components of the surface equipment 140 via the conductor 122. The downhole portion 114 of the tool string 110 may also comprise at least one electrical conductor 115, wherein the at least one electrical conductor 113 and the at least one electrical conductor 115 may be in electrical communication via at least one electrical conductor 117 of the release tool 116. Thus, one or more of the uphole portion 112, downhole portion 114, and the release tool 116 may be electrically connected with one or more components of the surface equipment 140, such as the power and control system 150, via the electrical conductors 113, 115, 117, 122. For example, the electrical conductors 113, 115, 117, 122 may transmit and/or receive electrical power, data, and/or control signals between the power and control system 150 and one or more of the uphole portion 112, the downhole portion 114, and the release tool 116. The electrical conductors 113, 115, 117 may further facilitate electrical communication between two or more of the uphole portion 112, the downhole portion 114, and the release tool 116. Each of the uphole portion 112, the downhole portion 114, the release tool 116, and/or portions thereof may comprise one or more electrical connectors and/or interfaces, such as may electrically connect the electrical conductors 113, 115, 117, 122.

The uphole and downhole portions 112, 114 of the tool string 110 may each be or comprise at least a portion of one or more downhole tools, modules, and/or other apparatus operable in wireline, while-drilling, coiled tubing, completion, production, and/or other implementations. For example, the uphole and downhole portions 112, 114 may each be or comprise one or more of an acoustic tool, a cable head, a cutting tool, a density tool, a directional tool, an electrical power module, an electromagnetic (EM) tool, a formation testing tool, a fluid sampling tool, a gravity tool, a formation logging tool, a hydraulic power module, a magnetic resonance tool, a formation measurement tool, a jarring tool, a mechanical interface tool, a monitoring tool, a neutron tool, a nuclear tool, a perforating tool, a photoelectric factor tool, a plug setting tool, a porosity tool, a power module, a ram, a reservoir characterization tool, a resistivity tool, a seismic tool, a stroker tool, a surveying tool, and/or a telemetry tool, among other examples also within the scope of the present disclosure.

Although FIG. 1 depicts the tool string 110 comprising a single release tool 116 directly coupled between the tool string portions 112, 114, it is to be understood that the tool string 110 may include two, three, four, or more release tools 116, each coupled between one or more of the downhole tools, modules, and/or other apparatus forming the tool string portions 112, 114. Furthermore, the tool string 110 may comprise a different number of tool string portions 112, 114, wherein each tool string portion 112, 114 may be directly and/or indirectly coupled with the release tool 116.

Figure 2:
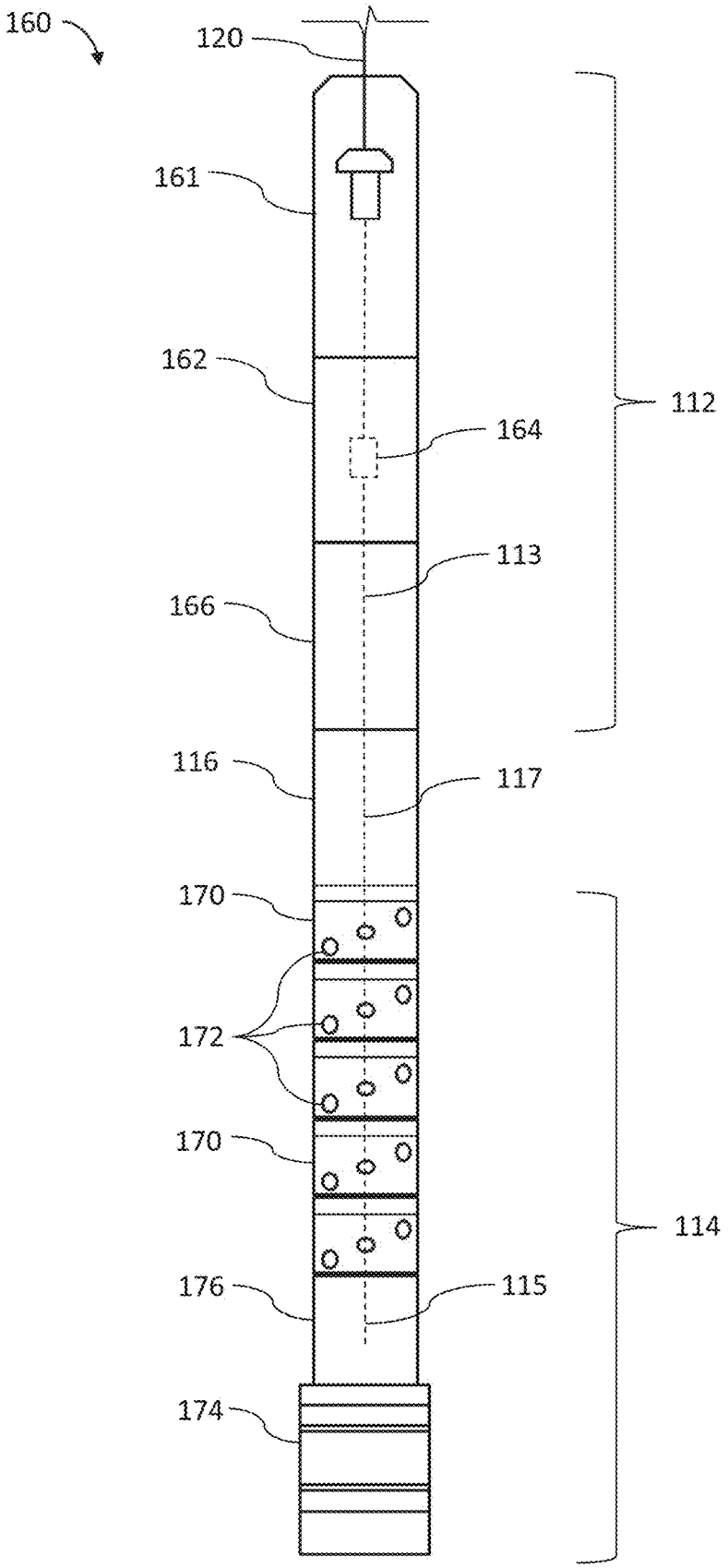
FIG. 2 is a schematic view of at least a portion of an example implementation of apparatus according to one or more aspects of the present disclosure.

FIG. 2 is a schematic side view of at least a portion of an example implementation of a tool string 160 according to one or more aspects of the present disclosure. The tool string 160 comprises one or more features of the tool string 110 described above and shown in FIG. 1, including where indicated by like reference numerals, except as described below. The following description refers to FIGS. 1 and 2, collectively.

An uphole portion 112 of the tool string 160 may comprise a cable head 161, which may be operable to connect a conveyance means 120 with the tool string 160. The uphole portion 112 may further comprise a telemetry/control tool 162, such as may facilitate communication between the tool string 160 and the surface equipment 140 and/or control of one or more portions of the tool string 160. The telemetry/control tool 162 may comprise a downhole controller 164 communicatively connected with the power and control system 150, including the surface controller 156, via conductors 113, 122 and with other portions of the tool string 160 via conductors 113, 115, 117. The downhole controller 164 may be operable to receive, store, and/or process control commands from the power and control system 150 for controlling one or more portions of the tool string 160. The controller 164 may be further operable to store and/or communicate to the power and control system 150 signals or information generated by one or more sensors or instruments of the tool string 160.

The telemetry/control tool 162 may further comprise inclination sensors and/or other sensors, such as one or more accelerometers, magnetometers, gyroscopic sensors (e.g., micro-electro-mechanical system (MEMS) gyros), and/or other sensors for determining the orientation of the tool string 160 relative to the wellbore 102. The telemetry/control tool 162 may further comprise a depth correlation tool, such as a casing collar locator (CCL) for detecting ends of casing collars by sensing a magnetic irregularity caused by the relatively high mass of an end of a collar of the casing 108. The correlation tool may also or instead be or comprise a gamma ray (GR) tool that may be utilized for depth correlation. The CCL and/or GR may be utilized to determine the position of the tool string 160 or portions thereof, such as with respect to known casing collar numbers and/or positions within the wellbore 102. Therefore, the CCL and/or GR tools may be utilized to detect and/or log the location of the tool string 160 within the wellbore 102, such as during deployment within the wellbore 102 or other downhole operations.

The uphole portion 112 of the tool sting 160 may further comprise a jarring or impact tool 166 operable to impart an impact to a stuck portion of a tool string 160, such as a downhole portion 114 of the tool sting 160, to help free the stuck portion of a tool string 160. The energy for the impact may be stored in the conveyance means 120 for conveying the tool string 160 into the wellbore 102. Namely, when a portion of the tool string 160 gets stuck or jammed within the wellbore 102, the conveyance means 120 may be pulled in an uphole (i.e., upward) direction by the tensioning device 130 to build up tension and, thus, store energy in the stretched conveyance means 120 to be released by the impact tool 166. However, the energy for the impact may also or instead be stored as a pressure differential between internal and external portions of the impact tool 166, which may be utilized to actuate the impact tool 166 to impart the impact to the stuck portion of the tool string 160. As described below, such impact tool 166 may include an internal chamber and a slidable or otherwise movable sealing member, such as a piston and shaft assembly, to fluidly isolate the chamber from a space (e.g., wellbore 102) external to the impact tool 166 to store the energy that may be selectively released to generate the impact. Although FIG. 2 depicts the tool string 160 comprising the impact tool 166, the impact tool 166 may not be included within the tool string 160. Thus, if the tool string 160 becomes stuck within the wellbore 102, other means of freeing the tool string 160 may be utilized.

The downhole portion 114 of the tool string 160 may comprise one or more perforating guns or tools 170, such as may be operable to perforate or form holes though the casing 108, the cement 109, and the portion of the formation 106 surrounding the wellbore 102 to prepare the well for production. The perforating tools 170 may contain one or more shaped explosive charges 172 operable to perforate the casing 108, the cement 109, and the formation 106 upon detonation. The lower portion 114 of the tool string 160 may also comprise a plug 174 and a plug setting tool 176 for setting the plug 174 at a predetermined position within the wellbore 102, such as to isolate or seal a downhole portion of the wellbore 102. The plug 174 may be permanent or retrievable, facilitating the lower portion of the wellbore 102 to be permanently or temporarily isolated or sealed, such as during treatment operations conducted on an upper portion of the wellbore 102.

The tool string 160 may further comprise a release tool 116 coupling the upper and lower tool string portions 112, 114 and selectively operable to uncouple, disconnect, part, or otherwise release the uphole and downhole tool string portions 112, 114 from each other while the tool string 160 is conveyed within the wellbore 102. The release tool 116 may permit a portion of the tool string 160 connected downhole from (i.e., below) the release tool 116 to be left in the wellbore 102 and a portion of the tool string 160 located uphole from (i.e., above) the release tool 116 may be retrieved to the wellsite surface 104. Accordingly, if a portion of the tool string 160 is stuck within the wellbore 102 and cannot be freed, such as via the impact tool 166, the release tool 116 located uphole from the stuck portion of the tool string 160 may be operated to release the free portion of the tool string 160 such that it may be retrieved to the wellsite surface 104. Although the tool string 160 is shown comprising a single release tool 116 coupled between the impact tool 166 and the perforating tools 170, it is to be understood that one or more additional release tools 116 may be coupled at other locations along the tool string 160, such as between the telemetry/control tool 162 and the impact tool 166 and/or between the perforating tools 170 and the plug 174.

Figure 3:
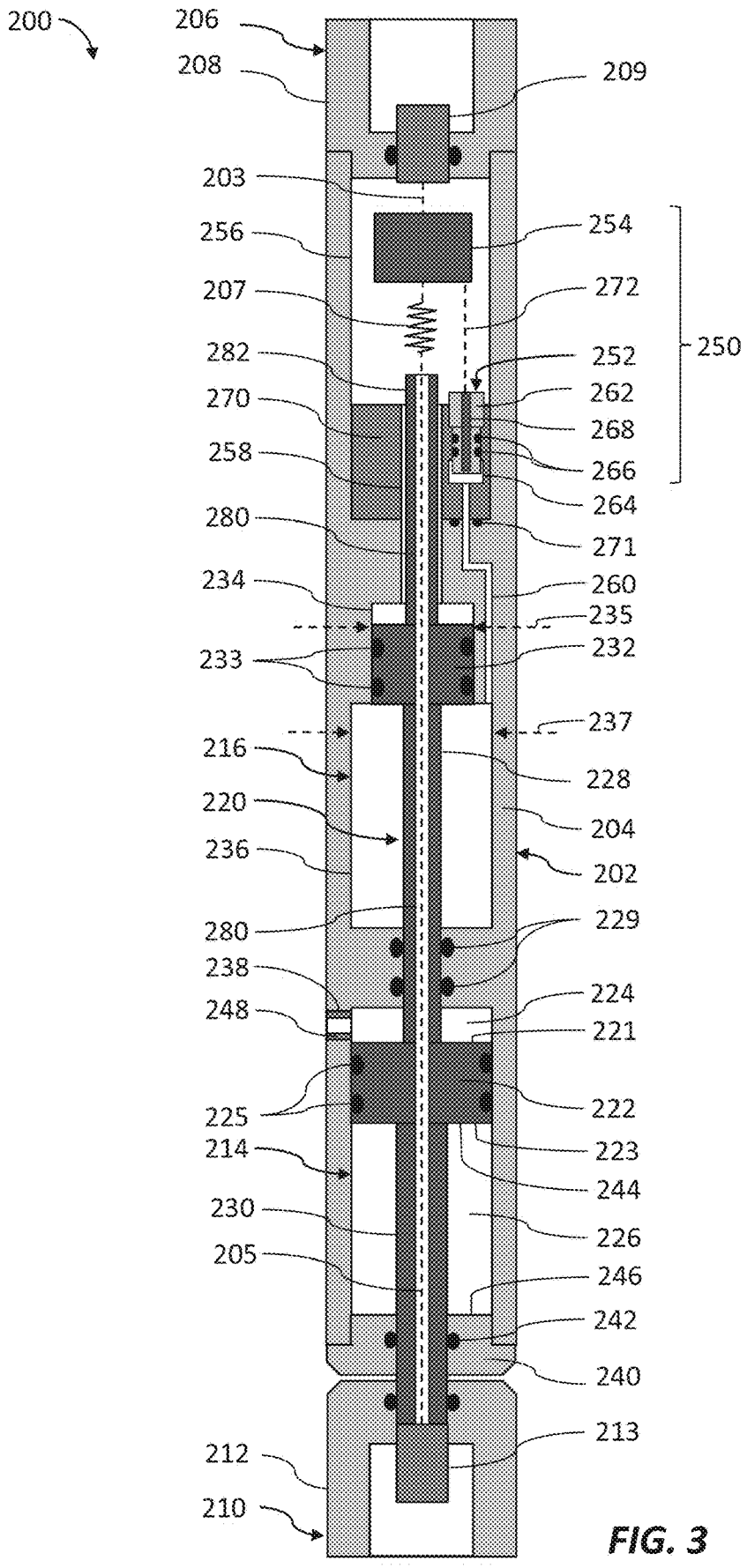
FIG. 3 is a schematic view of at least a portion of an example implementation of apparatus according to one or more aspects of the present disclosure.
Figure 4:
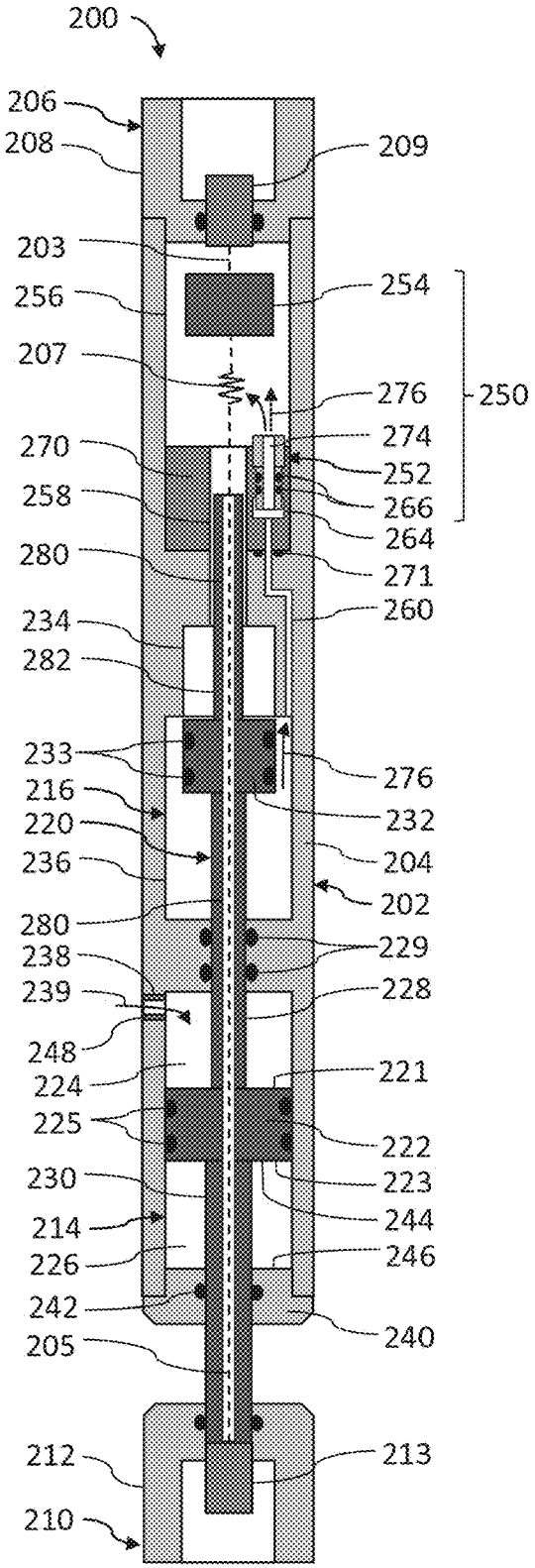
FIG. 4 is a schematic view of the apparatus shown in FIG. 3 at a different stage of operation according to one or more aspects of the present disclosure.
Figure 5:
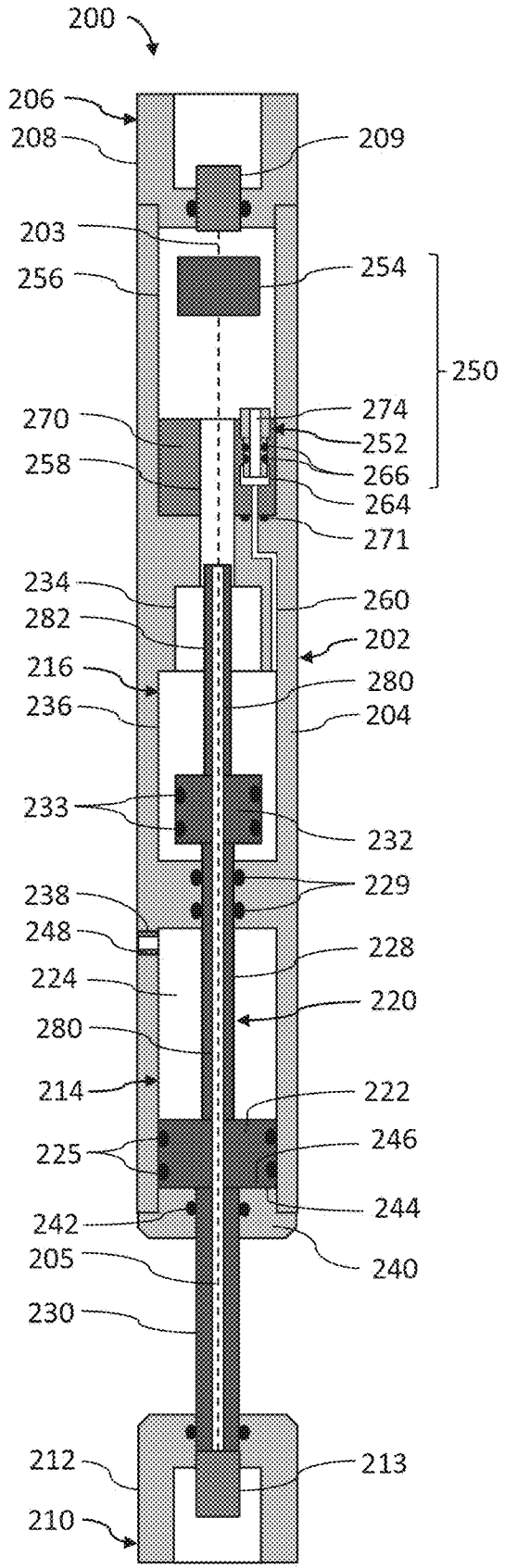
FIG. 5 is a schematic view of the apparatus shown in FIGS. 3 and 4 at a different stage of operation according to one or more aspects of the present disclosure.

FIG. 3 is a schematic sectional view of at least a portion of an example implementation of an impact tool 200 according to one or more aspects of the present disclosure. FIGS. 4 and 5 show the impact tool 200 shown in FIG. 3 at different stages of impact operations. The impact tool 200 may comprise one or more features of the impact tool 166 described above and shown in FIG. 2, except as described below. The following description refers to FIGS. 1-5, collectively.

The impact tool 200 comprises a housing 202 defining or otherwise encompassing a plurality of internal spaces or volumes containing various components of the impact tool 200. As introduced herein, the impact tool 200 may be operable to store energy in the form of pressure differential between hydrostatic wellbore pressure external to the impact tool 200 and an appreciably lower pressure within the internal spaces of the impact tool 200 and to release or utilize such pressure differential to perform work in the form of a downhole impact. Although the housing 202 is shown as comprising a single unitary member, it is to be understood that the housing 202 may be or comprise a plurality of housing sections coupled together to form the housing 202.

An uphole end 206 of the impact tool 200 may include a mechanical interface, a sub, a crossover, and/or other means 208 for mechanically coupling the impact tool 200 with a corresponding mechanical interface (not shown) of the telemetry/control tool 162 or another tool of the uphole portion 112 of the tool string 110. The interface means 208 may be integrally formed with or coupled to the housing 202, such as via a threaded connection. A downhole end 210 of the impact tool 200 may include a mechanical interface, a sub, a crossover, and/or other means 212 for mechanically coupling with a corresponding mechanical interface (not shown) of the release tool 116 or another tool of the uphole portion 112 of the tool string 110. The interface means 212 may be integrally formed with or coupled to the impact tool 200, such as via a threaded connection. The interface means 208, 212 may be or comprise threaded connectors, fasteners, box couplings, pin couplings, and/or other mechanical coupling means. Although the interface means 208, 212 is shown implemented as a box connector in FIGS. 3-5, one or both of the interface means 208, 212 may be implemented as pin connector, for example.

The uphole interface means 208 and/or other portion of the uphole end 206 of the impact tool 200 may further include an electrical interface 209 comprising means for electrically coupling an electrical conductor 203 extending along a portion of the impact tool 200 with a corresponding electrical interface (not shown) of the telemetry/control tool 162 or another portion of the uphole portion 112 of the tool string 110. The downhole interface means 212 and/or other portion of the downhole end 210 of the impact tool 200 may include an electrical interface 213 comprising means for electrically coupling an electrical conductor 205 extending along a portion of the impact tool 200 with a corresponding electrical interface (not shown) of the release tool 116 or another portion of the uphole portion 112 of the tool string 110. The electrical interfaces 209, 213 may each comprise electrical connectors, plugs, pins, receptacles, terminals, conduit boxes, and/or other electrical coupling means.

The impact tool 200 may comprise chambers 214, 216 within the housing 202 and a tandem piston assembly 220 slidably or otherwise movingly disposed within the housing 202. The piston assembly 220 may comprise a piston 222 slidably disposed within the chamber 214, dividing the chamber 214 into opposing chamber volumes 224, 226. The piston 222 may slidably and sealingly engage an inner surface of the chamber 214 to fluidly separate the chamber volumes 224, 226. The piston 222 may carry fluid seals 225 (e.g., O-rings or cup seals) that may fluidly seal against the inner surface of the chamber 214 to prevent fluids located on either side of the piston 222 from leaking between the chamber volumes 224, 226. The chamber 216 may include chamber portions 234, 236 having different inner diameters 235, 237, wherein the inner diameter 235 of the chamber portion 234 may be appreciably smaller than the inner diameter 237 of the chamber portion 236. The piston assembly 220 may further comprise a piston 232 movably disposed within the chamber 216. While the piston 232 is positioned within the chamber portion 234, the piston 232 may slidably and sealingly engage an inner surface of the chamber portion 234 to fluidly separate the chamber portions 234, 236. The piston 232 may carry fluid seals 233 that may fluidly seal against the inner surface of the chamber portion 234 to prevent fluids located on either side of the piston 232 from leaking between the chamber portions 234, 236. However, when the piston 232 moves out of the chamber portion 234 into the chamber portion 236, the fluid seals 233 or other portions of the piston 232 may not engage and seal against an inner surface of the chamber portion 236, permitting fluid within the chamber portion 236 to move around or past the piston 232. A rod or shaft 228 may extend between the pistons 222, 232, for example, through a bore or pathway extending through the housing 202 between the chambers 214, 216. The shaft 228 may connect the pistons 222, 232 such that the pistons 222, 232 move substantially in unison. Fluid seals 229 may be disposed between the housing 202 and the shaft 228 to prevent or reduce fluid communication between the chamber volume 224 of the chamber 214 and the chamber portion 236 of the chamber 216.

The piston assembly 220 may further comprise a rod or shaft 230 connected with the piston 222 opposite the shaft 228. The shaft 230 may be axially movable within the chamber 214 and out of the housing 202 at a downhole end of the housing 202. A stop section 240 of the housing 202 may retain the piston 222 within the chamber 214 and fluidly seal against the shaft 230 to isolate the chamber volume 226 from the space external to the housing 202. The stop section 240 may comprise a central opening to permit the shaft 230 to axially move out of the housing 202 and a fluid seal 242 to fluidly seal against the shaft 230 to prevent fluid located external to the housing 202 from leaking into the chamber volume 226. Opposing end of the shaft 230 may be fixedly coupled with the downhole mechanical interface 212. Accordingly, the piston 222 and shaft 230 can connect the housing 202 and the uphole mechanical interface 208 with the downhole mechanical interface 212 to connect portions of the tool string 110 located uphole and downhole from the impact tool 200.

The chamber volume 224 may be open to space external to the housing 202 and the chamber volume 226 may be fluidly isolated from the space external to the housing 202 by the piston 222. Thus, the piston 222 and shaft 230 may collectively function as a sealing member or device operable to fluidly isolate the chamber volume 226 from pressure and wellbore fluid within the space external to the impact tool 200. A face surface area 221 of the piston 222 may be exposed to the pressure within the space external to the housing 202 and an opposing face surface area 223 may be exposed to pressure within the chamber volume 226. The chamber volume 224 may be open to or in fluid communication with the space external to the housing 202 via one or more ports 238 extending through a wall 204 of the housing 202 at or near an uphole end of the chamber 214. Accordingly, when the impact tool 200 is conveyed downhole, the one or more ports 238 may permit wellbore fluid located within the wellbore 102 to be in communication with the chamber volume 224 such that the pressure within the chamber volume 224 can be made substantially equal to the hydrostatic pressure within the wellbore 102 external to the housing 202.

However, while the impact tool 200 is conveyed downhole, the piston assembly 220 and, thus, the piston 222 may be maintained in a substantially fixed position such that the pressure within the chamber volume 226 is maintained substantially constant (e.g., atmospheric pressure) or otherwise appreciably lower than the wellbore pressure external to the housing 202. Accordingly, when wellbore fluid is introduced into the chamber volume 224, a pressure differential across the piston 222 may be formed while the impact tool 200 is conveyed downhole, imparting a downhole force to the piston 222 and an uphole force to the housing 202 to urge relative movement (i.e., expansion) between the piston assembly 220 and the housing 202. The downhole and uphole forces formed by pressure differential across the piston 222 may be collectively referred to hereinafter as an "expansion force." Although the present disclosure may describe the piston assembly 220 as the moving component of the impact tool 200, it is done so for clarity and ease of understanding. It is to be understood that the expansion force may cause the housing 202 to move with respect to the piston assembly 220, for example, when the uphole tool string portion 112 is free and the downhole tool string portion 114 is stuck within the wellbore 102.

The impact tool 200 may further comprise an impact feature 244 operable to impact or collide with a corresponding impact feature 246 to bring the relative motion between the piston assembly 220 and the housing 202 to a sudden stop to generate the impact. The impact feature 244 may be implemented as an outwardly extending radial surface, shoulder, boss, flange, platen, and/or another impact member integral to or otherwise carried by the piston assembly 220 and the corresponding impact feature 246 may be implemented as an inwardly extending radial surface, shoulder, boss, flange, platen, and/or another impact member integral to or otherwise carried by the housing 202. For example, the impact feature 244 may be integral to or carried by a downhole portion or end of the piston 222, and the impact feature 246 may be integral to or carried by an uphole portion of the stop section 240 of the housing 202. However, the impact features 244, 246 may be integral to or carried by other portions of the impact tool 200. For example, the impact feature 244 may be integral to or carried by the shaft 230, and the impact feature 246 may be integral to or carried by other portions of the housing 202 defining the chamber 214. The impact feature 244 may alternatively be integral to or carried by the shaft 228 or piston 232 and the impact feature 246 may be integral to or carried by a portion of the housing 202 defining the chamber portion 236.

The piston assembly 220 and the housing 202 may be selectively locked or held in a substantially constant relative position resisting the expansion force generated by the pressure differential across the piston 222. For example, hydraulic or another fluid may be introduced and fluidly sealed within the chamber portion 236 of the chamber 216 prior to the impact tool 200 being conveyed downhole. Such hydraulic fluid may be substantially incompressible and, thus, operable to prevent the piston 232 from moving out of the chamber portion 234 into the chamber portion 236. Although the piston 232 may drift slightly into the chamber portion 236 during downhole conveyance, the piston assembly 220 may be maintained in a substantially constant position with respect to the housing 202 while the pressure within the chamber volume 224 increases as the impact tool 200 is conveyed downhole.

A triggering or release mechanism 250 may be provided within the housing 202 or another portion of the impact tool 200 to selectively release the piston 232 to permit the expansion force to move the piston assembly 220 and the housing 202 relative to each other. The operation of the piston assembly 220 and the release mechanism 250 is described in additional detail below.

FIG. 3 shows the impact tool 200 in a contracted or untriggered position, in which the impact tool 200 comprises a minimum overall length measured between the uphole and downhole ends 206, 210 of the impact tool 200. In such position, which is referred to hereinafter as a first impact tool position or first position, the piston 222 may be located at the uphole end of the chamber 214, the piston 232 may be fully disposed within the chamber portion 234, and the shaft 230 may be retracted into the housing 202. The release mechanism 250 may be operable to maintain the piston assembly 220 and the housing 202 in the first position until the release mechanism 250 is operated or triggered to permit relative motion between the piston assembly 220 and housing 202 and, thus, permit the impact features 244, 246 to move toward collision.

An example release mechanism 250 may include a fluid blocking device 252 and a switch 254 operable to electrically operate the fluid blocking device 252. One or more portions of the release mechanism 250 may be disposed within a chamber 256 within the housing 202. The chamber 256 may be fluidly connected with the chamber portion 234 of the chamber 216 via a fluid pathway 258. Because the chamber 256 and chamber portion 234 are fluidly connected by the fluid pathway 258, the chamber 256, the chamber portion 234, and the fluid pathway 258 may be collectively considered a single continuous space or chamber. The chamber 256 may be fluidly connected with the chamber portion 236 of the chamber 216 via a fluid pathway 260. The fluid blocking device 252 may be installed along or otherwise in association with the fluid pathway 260 and operable to block fluid flow through the fluid pathway 260 to fluidly isolate the chamber 256 and chamber portion 234 from the chamber portion 236. The fluid blocking device 252 may be or comprise a plug 262 disposed within a cavity 264 at an end of the fluid pathway 260. The plug 262 may be implemented as a bolt, which may be fixedly maintained within the cavity 264 via corresponding threads. Fluid seals 266 may be disposed between the plug 262 and inner surface of the cavity 264 to prevent fluid leakage around or past the plug 262. The plug 262 may contain an explosive charge 268 operable to breach, pierce, or open the plug 262 or otherwise form a fluid pathway around, past, or through the plug 262 when detonated to permit fluid flow from the chamber portion 236 into the chamber 256 and chamber portion 234.

However, instead of comprising the plug 262 having the explosive charge 268 therein, the fluid blocking device 252 within the scope of the present disclosure may be or comprise a hydraulic valve (not shown) operable to selectively permit fluid flow therethrough. Such valve may be sealingly disposed within the cavity 264 or otherwise along the fluid pathway 260 between the chamber 256 and chamber portion 234. The hydraulic valve may be or comprise a cartridge valve, a spool valve, a ball valve, a needle valve, a globe valve, or another valve operable at high pressures associated with downhole operations to shift between closed and open flow positions to selectively permit fluid flow therethrough. The hydraulic valve may be actuated by an electrical actuator (not shown), such as a solenoid or an electrical motor, a hydraulic actuator, such as a hydraulic cylinder or motor, or by other means. The valve actuator may be electrically connected to the switch 254 via the electrical conductor 272, such as may permit the hydraulic valve to be actuated from the wellsite surface 104.

The cavity 264 and perhaps a portion of the fluid pathway 260 may be located within or extend through a support member or block 270. The support block 270 may be separate and distinct from the housing 202 and may be disposed within the chamber 256. The support block 270 may be a sacrificial member operable to absorb energy, such as from the detonation of the explosive charge 268. The support block 270 may be replaced if damaged by the detonation of the explosive charge 268 without having to replace one or more portions of the housing 202. One or more fluid seals 271 may be disposed between inner surface of the chamber 256 and the support block 270 around the fluid pathway 260 to prevent or inhibit fluid communication between the fluid pathway 260 and the chamber 256.

The switch 254 may be electrically connected with the fluid blocking device 252 via a conductor 272 and operable to detonate the explosive charge 268 and, thus, trigger the impact tool 200. The switch 254 may be an addressable switch, such as may be operated from the wellsite surface 104 by the power and control system 150 via the conductors 113, 122, 203 extending between the power and control system 150 and the switch 254. If multiple impact tools 200 are included within the tool string 110 for creating multiple impacts, multiple addressable switches 254 may permit each of the impact tools 200 to be triggered sequentially or otherwise independently. The switch 254 may also be or comprise a timer, such as may activate or trigger the release mechanism 250 at a predetermined time. The switch 254 may be battery powered to permit the release mechanism 250 to be triggered without the conductors 113, 122, 203 extending to the wellsite surface 104. Although the switch 254 is shown and described herein as being configured for wired communication, it is to be understood that the switch 254 may be configured for wireless communication with a corresponding wireless device located at the wellsite surface 104 or another portion of the tool string 110. Such wireless switch may permit the release mechanism 250 to be triggered from the wellsite surface 104 without utilizing the conductors 113, 122, 203 extending to the wellsite surface 104.

The impact tool 200 may further comprise a continuous bore or pathway 280 extending longitudinally through various components of the impact tool 200, such as one or more of the chamber 256, the housing 202, the pistons 222, 232, and the shafts 228, 230. The pathway 280 may house therein the electrical conductors 203, 205 extending between electrical interfaces 209, 213. One or more portions of the electrical conductor 205 may be coiled 207 within the pathway 280 and/or the chamber 256, such as may permit the electrical conductor 205 to expand in length while the length of the impact tool 200 expands during the impact operations. A portion of the pathway 280 may be defined by a tubular member 282 connected with the piston 232 opposite the shaft 228 and extending through the fluid pathway 258. The tubular member 282 may protect the electrical conductor 205 from the pressure wave and/or high velocity particles caused by the detonation of the explosive charge 268 and/or from the impact operations. The tubular member 282 may also maintain the electrical conductor 205 within the pathway 280 while the housing 202 and the piston assembly 220 move with respect to each other during and/or after the impact operations. For example, the tubular member 282 may prevent the electrical conductor 205 from coiling up within the chamber portion 234 when the piston assembly 220 is retracted after the impact operations. One or more of the electrical conductors 203, 205, the electrical interfaces 209, 213, and the switch 254 may collectively form at least a portion of the electrical conductor 113 of the uphole portion 112 of the tool sting 110, such as may facilitate electrical communication with and/or through the impact tool 200.

Prior to being conveyed into the wellbore 102, the impact tool 200 may be configured to the first position such that the chamber volume 226 is formed and isolated from the space external to the housing 202. The pressure within the chamber volume 226 may be equalized with the atmospheric pressure at the wellsite surface 104. However, if additional impact force is intended to be delivered by the impact tool 200, air may be drawn or evacuated from the chamber volume 226 to reduce the pressure within the chamber volume 226 resulting in a larger pressure differential across the piston 222. Similarly, if a smaller impact force is intended to be delivered by the impact tool 200, air may be pumped into the chamber volume 226 to increase the pressure within the chamber volume 226 resulting in a smaller pressure differential across the piston 222 and, thus, a decrease in the amount of stored energy when the impact tool 200 is conveyed downhole. The impact tool 200 may then be connected along the tool string 110. After the impact tool 200 is configured and coupled to the tool string 110, the tool string 110 may be conveyed into the wellbore 102 to a predetermined depth or position to perform the intended wellbore operations.

As the tool string 110 is conveyed downhole, the hydrostatic pressure in the wellbore 102 external to the housing 202 of the impact tool 200 increases. However, because the chamber volume 226 is fluidly isolated from the wellbore fluid within the chamber volume 224, the pressure within the chamber volume 226 remains substantially constant or otherwise appreciably lower than the ambient wellbore pressure throughout the downhole conveyance of the tool sting 110. Similarly to the chamber volume 226, the chamber 256 and the chamber portion 234 may also be fluidly isolated from the chamber 214 and the wellbore 102 to maintain a substantially constant or otherwise appreciably lower pressure within the chamber 256 and the chamber portion 234 while the tool string 110 is conveyed downhole. Accordingly, when the tool string 110 reaches the predetermined depth or position within the wellbore 102, the pressure within the chamber volume 224 may be appreciably greater than the pressures within the chamber volume 226, the chamber 256, and the chamber portion 234. A net pressure differential may be formed across the piston 222 resulting in the expansion force urging movement (i.e., expansion) of the shaft 230 of the piston assembly 220 out of the housing 202. As described above, relative position between the piston assembly 220 and the housing 202 may be maintained substantially constant by the hydraulic fluid within the chamber portion 236. Because the hydraulic fluid is fluidly sealed within the chamber portion 236, the pressure of the hydraulic fluid increases, thereby resisting movement of the piston 232 into the chamber portion 236 and, thus, resisting movement between the piston assembly 220 and the housing 202.

Net expansion force urging relative movement between the piston assembly 220 and the housing 202 may be substantially determined based on the pressure differential across the piston assembly 220. The expansion force (i.e., force urging movement of the shaft 230 out of the housing 202) may be determined by multiplying the pressure within the chamber volume 224 by the uphole surface 221 of the piston 222 and by multiplying the pressure within the chamber 256 and chamber portion 234 by a cross-sectional area (not numbered) of the shaft 228. Contraction force (i.e., force urging movement of the shaft 230 into the housing 202) may be determined by multiplying the pressure within the chamber volume 226 by the downhole surface 223 of the piston 222 and by multiplying the pressure within the wellbore 102 by a cross-sectional area (not numbered) of the shaft 230. Calculating the difference between the expansion and contraction forces may substantially determine the net expansion force urging expansion (e.g., downhole movement of the piston assembly 220 with respect to the housing 202, uphole movement of the housing 202 with respect to the piston assembly 220) of the piston assembly 220 and the housing 202.

If the tool string 110 becomes stuck in the wellbore 102 such that it is intended to deliver an impact to the tool string 110, the impact tool 200 may be triggered, such as by operating the release mechanism 250, to impart the impact to the tool string 110 and dislodge the tool string 110. The impact tool 200 may progress though a sequence of operational stages or positions to release the energy stored in the impact tool 200 and impart the impact to the tool string 110. FIGS. 4 and 5 are schematic views of the impact tool 200 shown in FIG. 3 in subsequent stages of impact operations according to one or more aspects of the present disclosure.

FIG. 4 shows the impact tool 200 shortly after the release mechanism 250 was triggered to detonate the explosive charge 268 to form a fluid pathway 274 through or around the plug 262 and, thus, trigger the impact operations. After the fluid pathway 274 is formed, the pressurized hydraulic fluid within the chamber portion 236 can be permitted to flow through the fluid pathway 260 and the cavity 264 into the chamber 256 and chamber portion 234, as indicated by arrows 276. Evacuation of the hydraulic fluid out of the chamber portion 236 permits the piston 232 to enter the chamber portion 236 and, thus, permits relative motion between the housing 202 and the piston assembly 220. If the stuck portion of the tool string 110 is the uphole portion 112 of the tool string 110 or another portion located uphole from the impact tool 200, then the piston assembly 220 and the downhole portion 114 of the tool string 110 can move in the downhole direction with respect to the housing 202 and the stuck uphole portion 112 of the tool string 110. However, if the stuck portion of the tool string 110 is the downhole portion 114 or another portion of the tool string 110 located downhole from the impact tool 200, then the housing 202 and the uphole portion 112 of the tool string 110 can move in the uphole direction with respect to the piston assembly 220 and the stuck downhole portion 114 of the tool string 110.

The piston assembly 220 and the housing 202 can continue to move with respect to each other until the piston 232 exits the chamber portion 234, at which point the chamber portions 234, 236 are no longer fluidly isolated. In such position, the hydraulic fluid within the chamber portion 236 is free to flow around the piston 232 permitting unobstructed movement of the piston 232 within the chamber portion 236 and, thus, permitting free relative movement between the piston assembly 220 and the housing 202. The expansion force generated by the wellbore fluid pressure within the chamber volume 224 may then increase relative velocity between the piston assembly 220 and the housing 202. The position of the impact tool 200 shown in FIG. 4 is referred to hereinafter as a second impact tool position or second position.

The wellbore fluid may continue or be allowed to flow into the chamber 214 via the port 238, as indicated by arrow 239, increasing the chamber volume 224 while decreasing the chamber volume 226. The piston assembly 220 and the housing 202 may continue to move with respect to each other until the impact features 244, 246 impact or collide with each other to suddenly decelerate and halt the moving portions of the impact tool 200 and the tool string 110, imparting the impact to the stuck portion of the tool string 110. FIG. 5 shows the impact tool 200 in the impact position when the impact features 244, 246 come into contact, referred to hereinafter as a third impact tool position or third position.

The impact tool 200 may be adjustable to control the magnitude of the impact generated by the impact tool 200. Wellbores may have different pressures and the same wellbore may have different pressures at different depths. Since energy available for creating the impact is proportional or otherwise directly related to the wellbore pressure in the space around the impact tool 200, the impact tool 200 may comprise a means of varying speed of the relative motion between the housing 202 and piston assembly 220 in order to impart the intended impact force. Accordingly, a flow restrictor 248 may be disposed within the port 238 to reduce or otherwise control the rate of fluid flow from the space external to the housing 202 into the chamber portion 224 through the port 238. Although FIGS. 3-5 show a single port 238 extending through the housing wall 204, the housing 202 may comprise a plurality of ports 238, such as distributed circumferentially around the housing 202 at or near the uphole end of the chamber 214, to fluidly connect the space external to the housing 202 with the chamber volume 224. One or more of the plurality of ports 238 may have a corresponding flow restrictor 248 disposed therein.

Before or after being coupled to the tool string 110, the impact tool 200 may be configured to generate and/or impart a predetermined impact force to the tool string 110 based on, for example, depth of the tool string 110 within the wellbore 102, weight of the tool string 110, and wellbore fluid properties, such as viscosity. The magnitude of the intended impact may also depend on structural strength or resiliency of the tool string 110 to withstand the impact force. Knowing such operational parameters may permit the wellsite operator to predict the velocity of the piston assembly 220 and, thus, adjust the one or more flow restrictors 248 to adjust the velocity of the piston assembly 220 as intended. For example, the impact tool 200 may be configured by selecting and installing one or more flow restrictors 248, such as may cause the impact tool 200 to generate and deliver the predetermined impact force. Because flow rate through an opening is typically proportional to a diameter and/or cross-sectional area of such opening, the rate at which the wellbore fluid flows into the chamber volume 224 may be controlled by selecting an appropriate orifice diameter of the flow restrictor 248. Since the wellbore fluid is generally substantially incompressible, reducing the rate of flow of the wellbore fluid into the impact tool 200 may reduce the rate of speed at which the piston assembly 220 and the housing 202 move with respect to each other, which in turn, may reduce the magnitude of the impact to the tool string 110.

Instead of or in addition to utilizing the flow restrictors 248, the flow rate at which the wellbore fluid enters the chamber volume 224 may be controlled by closing some of the ports 238 to prevent flow through the closed ports 238 in order to control a cumulative flow area (i.e., open area) of the ports 238. For example, one or more of the ports 238 may be blocked or closed off by one or more plugs (not shown) threadedly engaged or otherwise disposed within one or more of the ports 238. Furthermore, if multiple impact tools 200 are included within the tool string 110 for creating multiple impacts, the magnitude of the impact force imparted by each impact tool 200 may be controlled or adjusted independently. For example, the flow restrictors 248 or plugs may be utilized to set an increasing impact force schedule, wherein each subsequent impact force imparted by each subsequent impact tool 200 increases until the tool string 110 is set free.

In addition to utilizing one or more flow restrictors 248 or plugs, the magnitude of the impact may also be controlled by adjusting the cumulative uphole and downhole areas of the piston assembly 220. For example, the net expansion force generated by the impact tool 200 may be controlled by adjusting the diameters of the pistons 222, 232 and/or the diameters of the shafts 228, 230. The magnitude of the impact may also or instead be controlled by adjusting travel distance (i.e., the stroke distance) of the piston assembly 220 to adjust the distance over which the piston 220 assembly accelerates.

The impact tool 200 described above and shown in FIGS. 3-5 is oriented such that the shaft 230 extends from the housing 202 in the downhole direction. However, it is to be understood that the orientation of the impact tool 200 within the tool string 110 may be reversed, such that the impact tool end 210 is oriented in the uphole direction and the impact tool end 206 is oriented in the downhole direction, without affecting the operation of the impact tool 200.

Figure 6:
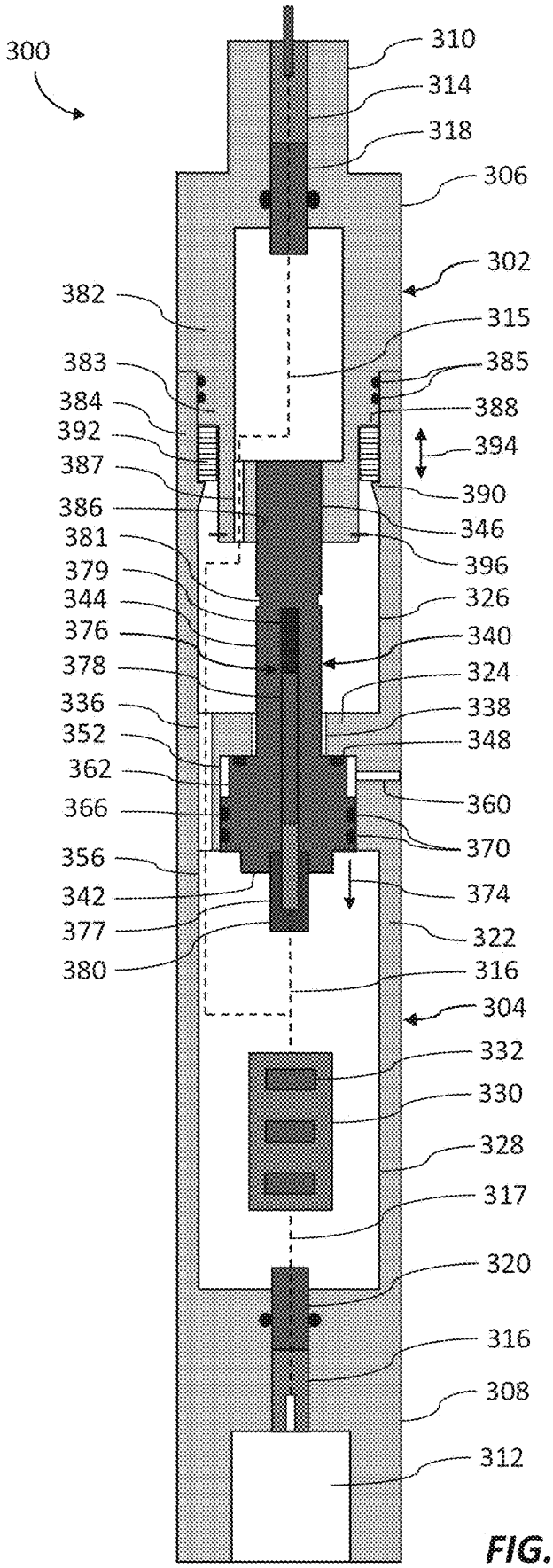
FIG. 6 is a schematic view of at least a portion of an example implementation of apparatus according to one or more aspects of the present disclosure.
Figure 7:
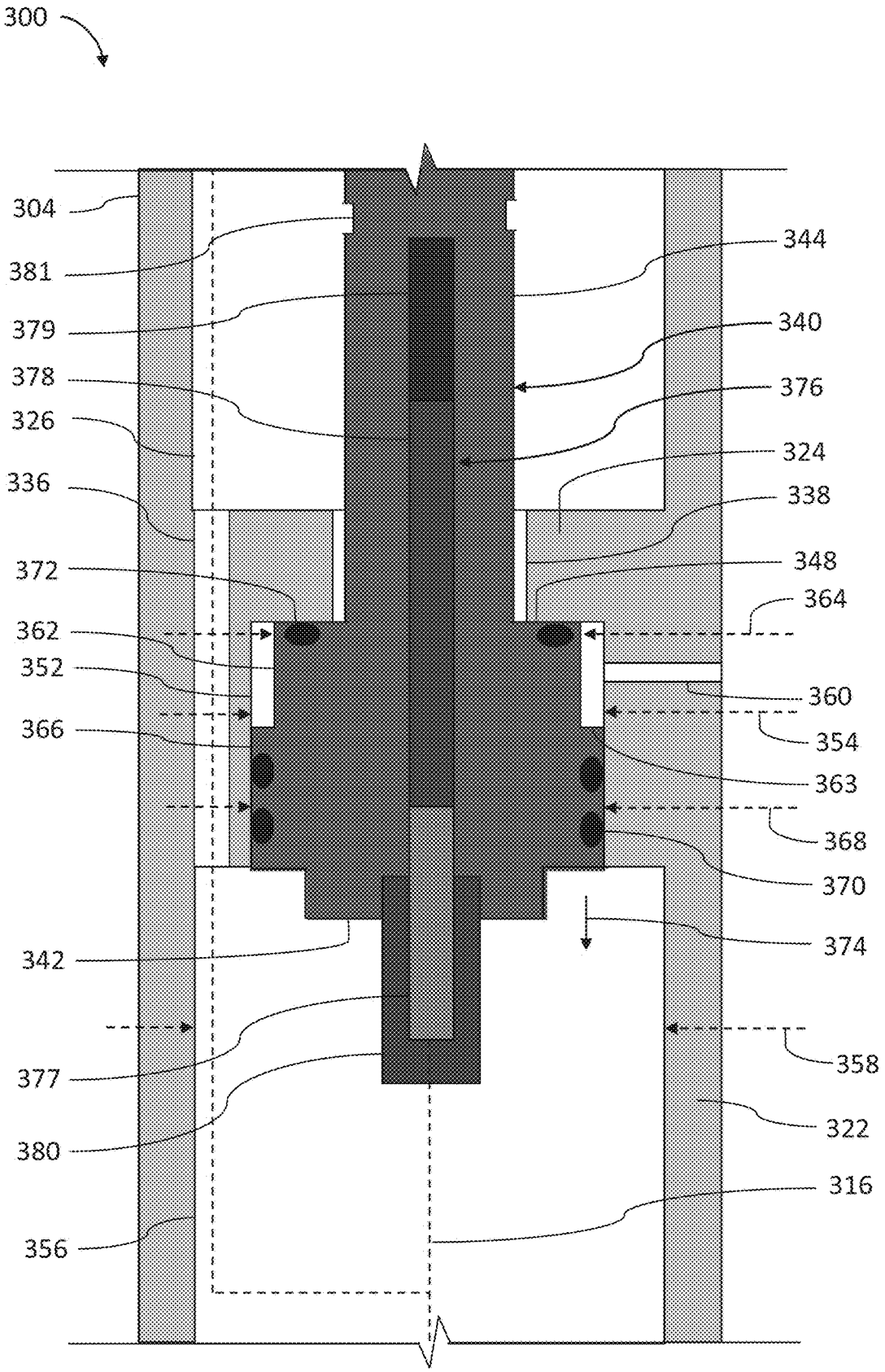
FIG. 7 is an enlarged view of a portion of the apparatus shown in FIG. 6 according to one or more aspects of the present disclosure.

FIG. 6 is a schematic sectional view of at least a portion of an example implementation of a release tool 300 according to one or more aspects of the present disclosure. FIG. 7 is an enlarged view of a portion of the release tool 300 shown in FIG. 6. The release tool 300 may comprise one or more features of the release tool 116 described above and shown in FIGS. 1 and 2, except as described below. The following description refers to FIGS. 1-2, 6, and 7, collectively.

As described herein, the tool string 110 may comprise the uphole portion 112, the downhole portion 114, and the release tool 300 coupled between and selectively operable to separate into two or more sections to uncouple, disconnect, part, or otherwise release the uphole portion 112 from the downhole portion 114 while conveyed within the wellbore 102. For example, if the downhole portion 114 is intended to be left in the wellbore 102, the release tool 300 may be operated downhole to separate and, thus, release the uphole and downhole portions 112, 114 from each other, which may then permit the uphole portion 112 to be retrieved to the wellsite surface 104. Also, if the downhole portion 114 is stuck within the wellbore 102 (rendering it the "stuck portion") and the impact tool 166 is unable to free it, the release tool 300 may be operated to separate and, thus, release the uphole portion 112 (in this case, the "free portion"), including the impact tool 166, from the stuck portion of the tool string 110, such that the free portion of the tool string 110 may be retrieved to the wellsite surface 104.

The release tool 300 may include an uphole connector section or sub 302 (a removable connector sub) operable to connect with the uphole portion 112 of the tool string 110 and a downhole connector section or sub 304 (a remaining connector sub) operable to connect with the downhole portion 114 of the tool string 110. The connector subs 302, 304 may collectively form or otherwise define one or more internal spaces, volumes, and/or chambers for accommodating or otherwise containing various components of the release tool 300, including one or more electrical conductors extending through the release tool 300. The connector subs 302, 304 may comprise corresponding heads 306, 308 (e.g., crossovers), which may include connectors, interfaces, and/or other means for mechanically and electrically coupling the release tool 300 with corresponding mechanical and electrical interfaces (not shown) of the uphole and downhole portions 112, 114 of the tool string 110. The uphole head 306 may include a mechanical interface, a sub, and/or other means 310 for mechanically coupling the release tool 300 with a corresponding mechanical interface of the impact tool 200 or another tool of the uphole portion 112 of the tool string 110. The downhole head 308 may include a mechanical interface, a sub, and/or other means 312 for mechanically coupling with a corresponding mechanical interface of the downhole portion 114 or another portion of the tool string 110 downhole from the release tool 300. Although the interface means 310, 312 are shown comprising ACME pin and box couplings, respectively, the interface means 310, 312 may alternatively comprise other pin and box couplings, threaded connectors, fasteners, and/or other mechanical coupling means.

The uphole interface means 310 and/or other portion of the uphole head 306 may further include an electrical interface 314 comprising means for electrically connecting an electrical conductor 315 extending through at least a portion of the release tool 300 with a corresponding electrical interface of the impact tool 166 or another tool of the uphole portion 112 of the tool string 110, whereby such corresponding electrical interface may be in electrical connection with the electrical conductor 113 of the uphole portion 112 of the tool string 110. The downhole interface means 312 and/or other portion of the downhole head 308 may include an electrical interface 316 comprising means for electrically connecting an electrical conductor 317 extending through at least a portion of the release tool 300 with a corresponding electrical interface of the downhole portion 114 of the tool string 110, whereby such corresponding electrical interface may be in electrical connection with the electrical conductor 115 of the downhole portion 114. Although the electrical interfaces 314, 316 are shown comprising a pin and a receptacle, respectively, the electrical interfaces 314, 316 may alternatively each comprise other electrical coupling means, including plugs, terminals, conduit boxes, and/or other electrical connectors.

Each of the uphole and downhole heads 306, 308 may further comprise additional bulkhead connectors 318, 320 configured to form a fluid seal along the electrical conductors 315, 317, such as to prevent or reduce the wellbore fluid or other external fluids from leaking into or out of the internal spaces or chambers of the release tool 300 along the electrical conductors 315, 317 during downhole operations.

The release tool 300 may contain or comprise an internal space or chamber at least partially formed or defined when the connector subs 302, 304 are connected. For example, the connector sub 304 may comprise an outer wall 322 (i.e., housing) containing or defining at least a portion of internal spaces or chambers 326, 328 and the connector sub 302 may comprise an outer wall 382 defining at least a portion of the internal space or chamber 326. The chambers 326, 328 may be partially separated by an inner wall 324 extending inward from the outer wall 322. Although the chambers 326, 328 are identified with different numerals for clarity and ease of understanding, the chambers 326, 328 may be fluidly connected and, thus in some embodiments, collectively considered as a single continuous space or chamber.

The chamber 328 may contain an electronics package 330, such as an electronics circuit board. The electronics package 330 may comprise various electronic components facilitating generation, reception, processing, recording, and/or transmission of electronic data. The electronics package 330 may also include a switch 332, which may comprise the same or similar structure and/or mode of operation as the switch 256 described above. The electronics package 330 may be electrically connected with or otherwise connected along the electrical conductors 315, 317 extending between the uphole and downhole electrical interfaces 314, 316, such as to permit communication of electronic data and/or electrical power between the electronics package 330, the uphole and downhole portions 112, 114 of the tool string 110, and/or the power and control system 150 at the wellsite surface 104. One or more of the electrical conductors 315, 317, the bulkhead connectors 318, 320, the electrical interfaces 314, 316, and the electronics package 330 may collectively form the electrical conductor 117, such as may facilitate electrical communication with and/or through the release tool 300.

The chamber 328 may include chamber portions having different inner diameters. For example, the chamber 328 may comprise an upper chamber portion 352 having an inner diameter 354 and a lower chamber portion 356 having an inner diameter 358, which may be appreciably larger than the inner diameter 354 of the chamber portion 352. The upper chamber portion 352 may be open to or in fluid communication with the space external to the release tool 300 via one or more ports 360 extending through the wall 322 and/or the inner wall 324 at or near an upper end of the upper chamber portion 352. Accordingly, when the release tool 300 is conveyed downhole, the port 360 may permit wellbore fluid located within the wellbore 102 to flow into or be in fluid communication with at least a part of the chamber portion 352 such that pressure within that part of the chamber portion 352 is substantially equal to hydrostatic pressure within the wellbore 102 external to the release tool 300. However, similarly to port 238, a flow restrictor (not shown) may optionally be disposed within the port 360 to reduce or otherwise control the rate of fluid flow from the space external to the release tool 300 into the chamber portion 352 through the port 360.

The chambers 326, 328 may be connected via bores or passages 336, 338 extending through the inner wall 324 between the chambers 326, 328. The passage 336 may extend between the chamber 326 and the lower chamber portion 356 of the chamber 328 and may accommodate therethrough the electrical conductor 315 extending between the electrical interface 314 and the electronics package 330.

The passage 338 may extend between the chamber 326 and the upper chamber portion 352 of the chamber 328 and may be configured to accommodate therethrough or receive therein at least a portion of a shaft, a bolt, or another fastener 340. Because the passage 336 fluidly connects the chamber 326 and the lower chamber portion 356 and the passage 338 fluidly connects the chamber 326 and the upper chamber portion 352, the chambers 326, 328 (including the chamber portions 352, 356) may be collectively considered as a single continuous space or chamber.

The fastener 340 may be utilized to couple the connector sub 302 with the connector sub 304. The fastener 340 may comprise a head 342 operable to latch against a portion of the connector sub 304. For example, the head 342 may be disposed against the inner wall 324 abutting an inwardly extending radial surface or shoulder 348 of the inner wall 324 surrounding the passage 338. The fastener 340 may further comprise a shank 344 connected with and extending from the head 342. The shank 344 may extend through the passage 338 into the chamber 326 and connect with the connector sub 302 to maintain connection between the connector subs 302, 304. The head 342 may be or operate as a piston slidably disposed within the upper chamber portion 352 of the chamber 328 and sealingly engaging a sidewall of the chamber portion 352. The shank 344 may terminate with a connection portion 346 coupled with the connector sub 302. In an example implementation, the connection portion 346 may comprise external threads operable to threadedly engage and, thus, fixedly connect with the connector sub 302.

The head 342 may include portions having different outer diameters. For example, the head 342 may comprise an upper head portion 362 having an outer diameter 364 and a lower head portion 366 having an outer diameter 368, which may be larger than the outer diameter 364 of the upper head portion 362. The head 342 may further comprise a transition face or surface 363 radially extending between the upper and lower head portions 362, 366. The head 342 may fluidly separate the upper chamber portion 352 and the lower chamber portion 356. For example, the lower head portion 366 may carry one or more fluid seals 370 configured to fluidly seal against the sidewall of the upper chamber portion 352 to prevent or reduce fluids from leaking between the chamber portions 352, 356. The head 342 may be further configured to fluidly separate the upper chamber portion 352 and the chamber 326. For example, the upper head portion 362 may carry one or more fluid seals 372 configured to fluidly seal against the shoulder 348 of the internal wall 324 to prevent or reduce fluids from leaking between the upper chamber portion 352 and the chamber 326 via the passage 338. Instead of or in addition to the fluid seal 372, a fluid seal (not shown) may be disposed within the passage 338 between the intermediate wall 324 and the shank 344 to prevent or reduce fluid flow via the passage 338.

Although the upper chamber portion 352 is exposed to the space external to the release tool 300, the upper chamber portion 352 may be fluidly isolated from the chamber 326 and the lower chamber portion 356. Accordingly, while the release tool 300 is conveyed within the wellbore 102 as part of the tool string 110, a pressure differential may be formed across the lower piston portion 366. Namely, while the release tool 300 is conveyed downhole, pressure within the chamber 326 and the lower chamber portion 356 may be maintained substantially constant or otherwise appreciably lower than pressure within the upper chamber portion 352, which is maintained at the hydrostatic wellbore pressure external to the release tool 300. When the tool string 110 reaches the predetermined depth or position within the wellbore 102, the pressure within the upper chamber portion 352 may be appreciably greater than the pressures within the chamber 326 and the lower chamber portion 356. The hydrostatic pressure applied to the transition surface 363 may impart a net downhole force on the piston head 342, biasing the fastener 340 in a downhole (i.e., downward) direction, as indicated by arrow 374. Accordingly, the head 342 of the fastener 340 can fluidly isolate or separate the chamber 326 and lower chamber portion 356 from the upper chamber portion 352 and port 360 to block the wellbore fluid from entering the chamber 326 and lower chamber portion 356 while the tool string 110 is located within the wellbore 102.

An explosive device 376 may be disposed within the fastener 340, which, when detonated, may sever, split, or otherwise separate the shank 344 radially to release or disconnect the connector sub 304 from the connector sub 302. The explosive device 376 may comprise a detonator switch 377 operable to cause detonation (e.g., via an electrical charge) of a detonator or primary charge 378, which in turn may cause detonation of a secondary charge 379, such as HMX or RDX. The explosive device 376 may be disposed within an axial bore or cavity extending through the head 342 and the shank 344 and be retained within the axial bore or cavity by a retainer cap 380 connected with the head 342. The secondary charge 379 may be located adjacent a cavity or notch 381 extending circumferentially around the shank 344, which may cause or help the secondary charge 379 to radially sever or split the shank 344 along the circumferential notch 381. The detonator switch 377 may be electrically connected with the electronics package 330 via electrical conductor 316. However, an external detonator switch, such as the detonator switch 332 described above, may be utilized to detonate the primary charge 378.

The wall 382 of the connector sub 302 may be configured to slidably engage the wall 322 of the connector sub 304 while being maintained in such slidably engaged position by the fastener 340 extending between and fixedly connecting the connector subs 302, 304. For example, the wall 322 of the connector sub 304 may comprise an upper portion 384 configured to slidably receive or otherwise accommodate therein a lower portion 383 of the wall 382 of the connector sub 302. One or more fluid seals 385 may be disposed between the lower and upper portions 383, 384, wherein the seals 385 may be configured to prevent or inhibit wellbore fluid from leaking into the upper chamber 326.

The lower portion 383 of the wall 382 may be configured to fixedly connect with the fastener 340 to connect the connector sub 302 with the fastener 340. For example, the lower portion 383 may comprise a threaded bore or opening 386 configured to threadedly engage the external threads of the connection portion 346 of the fastener 340. Accordingly, the release tool 300 may be assembled by at least partially inserting the lower portion 383 of the connector sub 302 into the upper portion 384 of the connector sub 304. Thereafter, the fastener 340 may be inserted into and through the upper chamber portion 352 of the lower chamber 328, the passage 338, and the upper chamber 326 and threadedly engage the threaded opening 386 of the connector sub 302. One of the connector sub 302 and the fastener 340 may be rotated to progressively engage the complementary threaded portions 346, 386, causing the lower portion 383 of the connector sub 302 to fully enter and sealingly engage the upper portion 384 of the connector sub 304. A predetermined torque may be applied to the fastener 340, such as to maintain the fastener 340 at a predetermined tension.

The lower portion 383 of the connector sub 302 may further include a bore or passage 387 extending through the lower portion 383 to accommodate therethrough the electrical conductor 315 extending between the electrical interface 314 and the electronics package 330. The lower portion 383 may also comprise a radially outward shoulder 388 and the upper portion 384 of the connector sub 304 may comprise a radially inward shoulder 390. A biasing member 392 may be disposed between the shoulders 388, 390. The biasing member 392 may be compressed between the shoulders 388, 390 when the lower portion 383 of the connector sub 302 slides into or enters the upper portion 384 of the connector sub 304 to generate a biasing expansion force, indicated by arrows 394, which may urge separation of the connector subs 302, 304. The biasing member 392 may therefore be compressible and may be or comprise one or more coil springs and/or Belleville washers, among other examples. A retaining member 396 (e.g., a retaining ring or washer) may extend around or radially outward from the lower portion 383 of the connector sub 302, such as to maintain the biasing member 392 about the lower portion 383 or otherwise in association with the connector sub 302 when the connector subs 302, 304 are separated.

FIGS. 6 and 7 show the release tool 300 in an inactivated position (representing first release tool position or first position), in which the release tool 300 is utilized to transmit tension and/or compression generated by the tensioning device 130 at the wellsite surface 104 to a portion of the tool string 110 located downhole from the release tool 300, such as during conveyance of the tool string 110. In the first position, the release tool 300 may be further operable to transmit tension and/or compression generated by the impact tool 166 incorporated into the tool sting 110. In an example implementation, the release device 300 may be operable to withstand a tension of about 100,000 pounds or more. Accordingly, one or more release tools 300 may be coupled along the tool string 110 uphole and/or downhole from the impact tool 166. Coupling the release tool 300 downhole from the impact tool 166 can permit the impact tool 166 to be recovered to the wellsite surface 104 if the impact tool 166 fails to free a stuck portion of the tool string 110.

As the tool string 110 is conveyed downhole along the wellbore 102, the hydrostatic pressure in the wellbore 102 external to the release tool 300 increases. However, the pressure within the lower chamber portion 356 and chamber 326 may remain substantially constant (allowing for component material compressibility) because the lower chamber portion 356 and chamber 326 are fluidly isolated by the head 342 of the fastener 340 from the upper chamber portion 352, which is exposed to the hydrostatic wellbore pressure via the port 360. Accordingly, when the tool string 110 reaches the predetermined depth or position within the wellbore 102, the pressure within the upper chamber portion 352 may be appreciably greater than the pressure within the lower chamber portion 356, resulting in a net pressure differential across at least a portion of the head 342 that can impart a net downhole (i.e., downward) force to the head 342.

Figure 8:
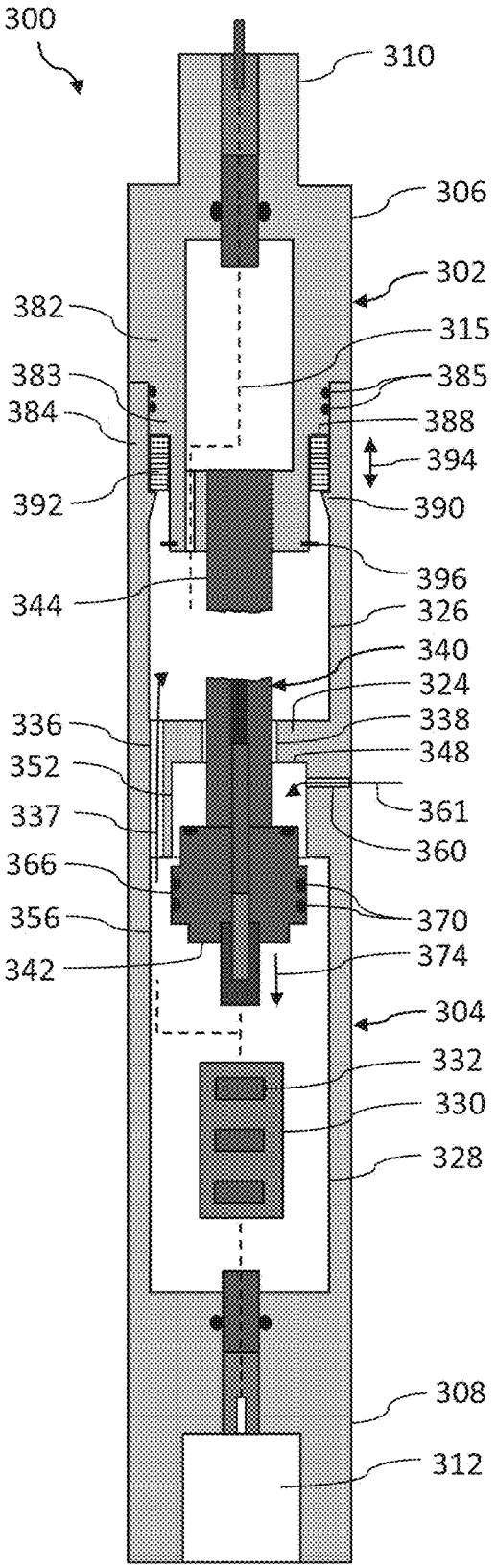
FIG. 8 is a schematic view of the apparatus shown in FIG. 6 at a different stage of operation according to one or more aspects of the present disclosure.
Figure 9:
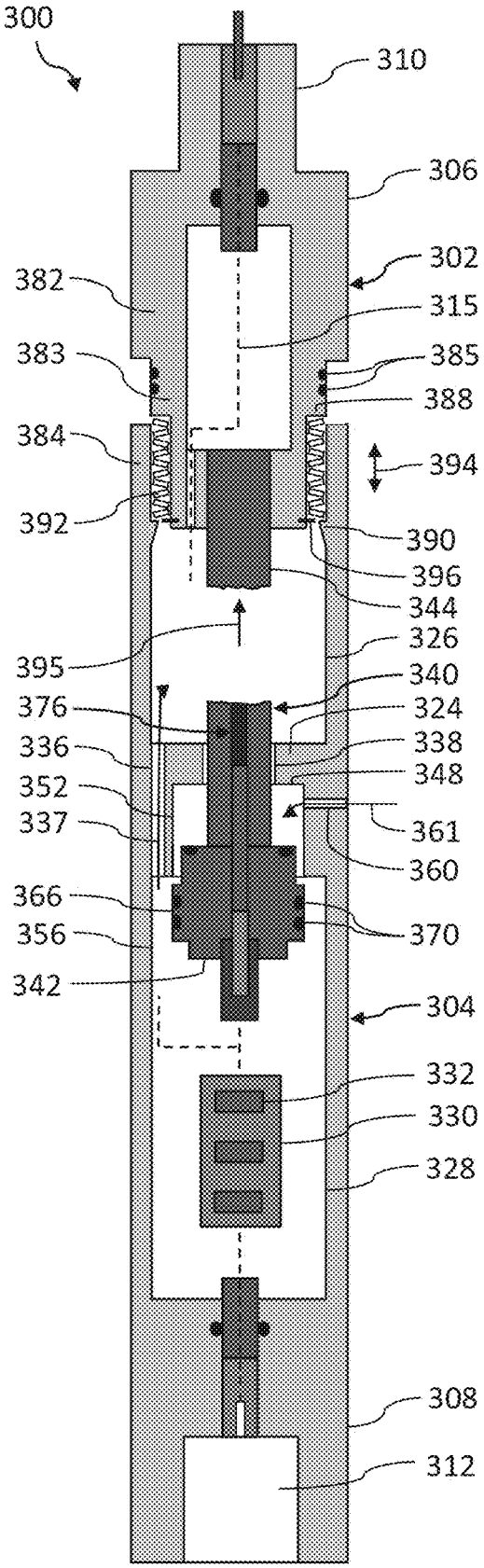
FIG. 9 is a schematic view of the apparatus shown in FIGS. 6 and 8 at a different stage of operation according to one or more aspects of the present disclosure.

If it is intended to release a portion of the tool string 110 coupled uphole from the release tool 300, the release tool 300 may be operated to disconnect the connector sub 302 from the connector sub 304. The release tool 300 may progress though a sequence of operational stages or positions during such release operations. FIGS. 8 and 9 are sectional views of the release tool 300 shown in FIGS. 6 and 7 in subsequent stages of release operations according to one or more aspects of the present disclosure. The following description refers to FIGS. 1-2 and 6-9, collectively.

FIG. 8 shows the release tool 300 in a second release tool position, or second position, shortly after the explosive charge 379 was detonated to sever, split, or separate the shank 344 of the fastener 340 and, thus, unlatch or disconnect the connector sub 304 and the connector sub 302 from each other. After the shank 344 separates, the head 342 is no longer restrained against the shoulder 348 of the internal wall 324, permitting the downhole force imparted on the head 342 by the wellbore pressure within the upper chamber portion 352 to move the head 342 in the downhole direction into the lower chamber portion 356, as indicated by arrow 374, and permitting the wellbore fluid to flow into the upper chamber portion 352 via the port 360, as indicated by arrow 361. After the lower head portion 366 moves out of the upper chamber portion 352, the wellbore fluid may flow from the upper chamber portion 352 into the lower chamber portion 356 and then into the chamber 326 via the passage 336, as indicated by arrow 337. The wellbore fluid may flow directly from the upper chamber portion 352 into the chamber 326 via the passage 338 when the fluid seals 372 disengage from the shoulder 348. Thus, when the explosive charge 379 separates the fastener 340, the hydrostatic pressure moves the head 342 permitting the wellbore fluid to flood the internal chambers of the release tool 300, including the chambers 326, 328.

Even if the explosive charge 379 does not by itself fully separate the shank 344, the internal tension applied to the shank 344 by the downhole force caused by the hydrostatic pressure within the upper chamber portion 352 may be operable to fully separate a partially severed fastener 340. For example, when detonated, the explosive charge 379 may create a split, crack, or cavity extending into or at least partially through the shank 344, decreasing the cross-sectional area and, thus, weakening the shank 344. The decreased cross-sectional area may increase internal stress along the shank 344, permitting the internal tension to fully separate the shank 344.

Flooding the internal chambers, including chambers 326, 328, of the release tool 300 may equalize pressure within such internal chambers with the pressure external to the release tool 300, eliminating any pressure differential that may cause the connector subs 302, 304 to be forced toward each other and, thus, held (i.e., stuck) together. Accordingly, after the internal chambers are flooded by the wellbore fluid to equalize the pressure within the internal chambers with the hydrostatic wellbore pressure, the connector subs 302, 304 may be separated from each other.

The inrush of the wellbore fluid into the chamber 326 may at least partially separate or move the connector sub 302 from within the connector sub 304. However, friction between the lower portion 383 of the connector sub 302 and the upper portion 384 of the connector sub 304, such as caused by the fluid seals 385 and/or metal-to-metal contact, may cause the connector subs 302, 304 not to fully separate when the explosive charge 379 severs the shank 344 of the fastener 340. Accordingly, the biasing member 392 may be installed to fully separate the connector subs 302, 304. When compressed between the shoulders 388, 390, the biasing member 392 may apply an expansion force to both the connector subs 302, 304 biasing the connector subs 302, 304 in opposing directions, as indicated by the arrows 394. Such expansion force may overcome the friction between the connector subs 302, 304 and push the connector sub 302 in the uphole direction out of the connector sub 304, as indicated by arrow 395, until the biasing member 392 fully expands and moves the connector sub 302 a distance sufficient to bypass sources of friction between the connector subs 302, 304, such as caused by the fluid seals 385 and/or interference fit (metal-to-metal) contact. FIG. 9 shows the release tool 300 in the fully separated position (third release tool position or third position), when the biasing member 392 is expanded and the lower portion 383 of the connector sub 302 is disconnected from the upper portion 384 of the connector sub 304.

The electrical conductor 315 may be severed by the blast caused by the explosive charge 379 or when the connector sub 302 is separated from the connector sub 304. After the fastener 340 is severed, tension may be applied to the tool string 110 by the tensioning device 130 at the wellsite surface 104 to retrieve the free uphole portion 112 of the tool string 110 and the connector sub 302 to the wellsite surface 104. The connector sub 304 left behind in the wellbore 102 may comprise means for engaging or coupling with wellbore fishing equipment (not shown), which may be deployed downhole when the uphole portion 112 is returned to the wellsite surface 104. The fishing equipment may be operable to locate and couple with the connector sub 304 in order to retrieve the stuck downhole portion 114 of the tool string 110.

The connector sub 304 may comprise internal or external features, such as may permit the connector sub 304 to be coupled with the wellbore fishing equipment during fishing operations. For example, the wall 322 of the connector sub 304 may comprise one or more external cavities, protrusions, or other profiles (e.g., an external fishing neck) operable for coupling with the wellbore fishing equipment (e.g., an outside grappling device) during fishing operations. However, the connector sub 304 may comprise a substantially smooth or uniform outer surface, such as may permit the connector sub 304 to be received or captured by an overshoot fishing tool (i.e., an external catch) during fishing operations. The connector sub 304 may also or instead comprise one or more internal cavities, protrusions, or other profiles (e.g., an internal fishing neck profile), which may be exposed when the connector sub 302 is removed and permit the fishing equipment (e.g., an inside grappling device, a spear) to enter and thread into or otherwise latch against the internal profile during fishing operations.

In view of the entirety of the present disclosure, including the figures and the claims, a person having ordinary skill in the art will readily recognize that the present disclosure introduces an apparatus comprising a downhole tool for connecting and selectively disconnecting within a wellbore first and second portions of a downhole tool string from each other, wherein the downhole tool comprises: a first connector sub connectable with the first portion of the downhole tool string; a second connector sub connectable with the second portion of the downhole tool string; an internal chamber; and a fastener connecting the first and second connector subs, wherein at least a portion of the fastener fluidly separates the internal chamber into a first chamber portion and a second chamber portion, wherein the first chamber portion is fluidly connected with a space external to the downhole tool, and wherein the downhole tool is selectively operable to disconnect the first and second connector subs from each other to disconnect the first and second portions of the downhole tool string from each other.

The first and second connector subs may at least partially define the internal chamber.

The first chamber portion may be fluidly connected with the space external to the downhole tool via a fluid port.

The fastener may be selectively operable to disconnect the first and second connector subs from each other to disconnect the first and second portions of the downhole tool string from each other. The fastener may contain an explosive charge selectively operable to detonate to sever the fastener and thus disconnect the first and second connector subs from each other. The fastener may comprise: a first fastener portion connected with the first connector sub; and a second fastener portion connected with the second connector sub, wherein the fastener is selectively operable to disconnect the first and second fastener portions from each other to disconnect the first and second connector subs from each other. The fastener may be or comprise a bolt, the first fastener portion may be or comprise a shank of the bolt, and the second fastener portion may be or comprise a head of the bolt. The first fastener portion may be threadedly connected with the first connector sub. The second fastener portion may be latched against a shoulder of the second connector sub, and the second fastener portion may be movable within the internal chamber when the first and second fastener portions are disconnected from each other. While the downhole tool is conveyed within the wellbore, a port may permit wellbore fluid to flow into the first chamber portion from the wellbore thereby forming a pressure differential between pressure within the first chamber portion and pressure within the second portion, and, after the first and second fastener portions are disconnected from each other, the pressure differential may facilitate movement of the second fastener portion within the internal chamber to fluidly connect the first chamber portion with the second chamber portion and thus permit flow of the wellbore fluid from the wellbore into the second chamber portion.

While the downhole tool is conveyed within the wellbore: pressure within the first chamber portion may increase; and pressure within the second chamber portion may be maintained lower than within the first chamber portion. While the downhole tool is conveyed within the wellbore, the pressure within the second chamber portion may be maintained substantially constant. While the downhole tool is conveyed within the wellbore, the pressure within the second chamber portion may be maintained substantially equal to atmospheric pressure at a wellsite surface from which the wellbore extends. While the downhole tool is conveyed within the wellbore, the pressure within the first chamber portion may be substantially equal to hydrostatic wellbore pressure external to the downhole tool.

The apparatus downhole tool may be selectively operable to disconnect the first portion of the downhole tool string from the second portion of the downhole tool string when the second portion of the downhole tool string becomes stuck within the wellbore to permit the first portion of the downhole tool string to be retrieved to a wellsite surface from which the wellbore extends.

One of the first and second connector subs may be at least partially inserted into another of the first and second connector subs, and the downhole tool may comprise a biasing member operable to facilitate separation of the first and second connector subs.

The downhole tool may comprise an electrical conductor extending between opposing ends of the downhole tool through the first and second connector subs.

The first portion of the downhole tool string may comprise a depth correlation tool, and the second portion of the downhole tool string may comprise a perforating tool.

The first portion of the downhole tool string may comprise a jarring tool operable to impart an impact to the downhole tool string.

The present disclosure also introduces an apparatus comprising a downhole tool for connecting and selectively disconnecting within a wellbore first and second portions of a downhole tool string from each other, wherein the downhole tool comprises: a first connector sub connectable with the first portion of the downhole tool string; a second connector sub connectable with the second portion of the downhole tool string, wherein the first and second connector subs at least partially define an internal chamber; and a fastener connecting the first and second connector subs and blocking wellbore fluid from entering the internal chamber while the downhole tool is within the wellbore, wherein the downhole tool is selectively operable while the downhole tool is within the wellbore to cause the fastener to separate into first and second fastener portions to permit the wellbore fluid to enter the internal chamber thereby disconnecting the first and second connector subs and thus the first and second portions of the downhole tool string from each other.

The internal chamber may be fluidly connected with the wellbore via a fluid port.

The fastener may contain an explosive charge selectively operable to detonate to separate the fastener into the first and second fastener portions.

The first fastener portion may be connected with the first connector sub, and the second fastener portion may be connected with the second connector sub.

The fastener may be or comprise a bolt, the first fastener portion may be or comprise a shank of the bolt, and the second fastener portion may be or comprise a head of the bolt.

The first fastener portion may be threadedly connected with the first connector sub.

The second fastener portion may be latched against a shoulder of the second connector sub, and the second fastener portion may be movable within the internal chamber when the first and second fastener portions are separated from each other.

After the first and second fastener portions are separated from each other, wellbore fluid pressure may facilitate movement of the second fastener portion within the internal chamber to permit flow of the wellbore fluid from the wellbore into the internal chamber.

While the downhole tool is conveyed within the wellbore, pressure within the internal chamber may be maintained lower than within the wellbore.

While the downhole tool is conveyed within the wellbore, the pressure within the internal chamber may be maintained substantially constant.

While the downhole tool is conveyed within the wellbore, the pressure within the internal chamber may be maintained substantially equal to atmospheric pressure at a wellsite surface from which the wellbore extends.

The downhole tool may be selectively operable to disconnect the first portion of the downhole tool string from the second portion of the downhole tool string when the second portion of the downhole tool string becomes stuck within the wellbore to permit the first portion of the downhole tool string to be retrieved to a wellsite surface from which the wellbore extends.

One of the first and second connector subs may be at least partially inserted into another of the first and second connector subs, and the downhole tool may comprise a biasing member operable to facilitate separation of the first and second connector subs.

The downhole tool may comprise an electrical conductor extending between opposing ends of the downhole tool through the first and second connector subs.

The first portion of the downhole tool string may comprise a depth correlation tool, and the second portion of the downhole tool string may comprise a perforating tool.

The first portion of the downhole tool string may comprise a jarring tool operable to impart an impact to the downhole tool string.

The present disclosure also introduces a method comprising: connecting a first connector sub of a downhole tool with a first portion of a downhole tool string and connecting a second connector sub of the downhole tool with a second portion of the downhole tool string to connect the first and second portions of the downhole tool string, wherein a fastener of the downhole tool connects the first and second connector subs; conveying the downhole tool string within a wellbore while the fastener blocks wellbore fluid from flowing into an internal chamber formed by the first and second connector subs; and operating the downhole tool such that the fastener separates into first and second fastener portions and permits the wellbore fluid to flow into the internal chamber thereby disconnecting the first and second connector subs and thus the first and second portions of the downhole tool string from each other.

The method may comprise assembling the downhole tool by: connecting the first fastener portion with the first connector sub; and connecting the second fastener portion with the second connector sub. Connecting the first fastener portion with the first connector sub may comprise threadedly engaging the first fastener portion with the first connector sub. Connecting the second fastener portion with the second connector sub may comprise slidably inserting the fastener into the internal chamber such that the second fastener portion: is disposed against a shoulder of the second connector sub; and fluidly isolates a fluid port from the internal chamber.

The method may comprise assembling the downhole tool by inserting a portion of one of the first and second connector subs into another of the first and second connector subs. Assembling the downhole tool may comprise compressing a biasing member while inserting the portion of one of the first and second connector subs into another of the first and second connector subs. Operating the downhole tool may cause the biasing member to facilitate separation of the first and second connector subs.

The method may comprise, while conveying the downhole tool within the wellbore, maintaining the internal chamber at a pressure that is lower than hydrostatic wellbore pressure.

The method may comprise, while conveying the downhole tool within the wellbore, maintaining the internal chamber at a pressure that is substantially equal to atmospheric pressure at wellsite surface from which the wellbore extends.

After the first and second fastener portions are separated from each other, wellbore fluid pressure may facilitate movement of the second fastener portion within the internal chamber to permit the wellbore fluid to flow from the wellbore into the internal chamber.

Operating the downhole tool may comprise detonating an explosive charge disposed in association with the fastener to separate the fastener into the first and second fastener portions.

Operating the downhole tool may be performed after the second portion of the downhole tool string becomes stuck within the wellbore to disconnect the first and second portions of the downhole tool string from each other to permit the first portion of the downhole tool string to be retrieved to wellsite surface from which the wellbore extends.

The method may comprise transmitting a signal from a wellsite surface from which the wellbore extends to the downhole tool to operate the downhole tool.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to allow the reader to quickly ascertain the nature of the technical disclosure. It is submitted with the understanding that it will not be used to interpret or limit the scope or meaning of the claims.

What is claimed is:

1. An apparatus comprising:

a downhole tool for connecting and selectively disconnecting within a wellbore first and second portions of a downhole tool string from each other, wherein the downhole tool comprises:

a first connector sub connectable with the first portion of the downhole tool string;

a second connector sub connectable with the second portion of the downhole tool string;

an electrical conductor extending within the first and second connector subs at least partially through a passage;

an internal chamber;

a fastener connecting the first and second connector subs, wherein:

the passage extends alongside the fastener;

at least a portion of the fastener fluidly separates the internal chamber into a first chamber portion and a second chamber portion;

the first chamber portion is fluidly connected with a space external to the downhole tool; and the downhole tool is selectively operable to disconnect the first and second connector subs from each other to disconnect the first and second portions of the downhole tool string from each other.

2. The apparatus of claim 1 wherein the passage extends through a wall of the first and/or second connector sub.

3. The apparatus of claim 1 wherein the passage does not extend through the fastener.

4. The apparatus of claim 1 wherein the fastener comprises:

a first fastener portion connected with the first connector sub; and a second fastener portion connected with the second connector sub, wherein the fastener is selectively operable to disconnect the first and second fastener portions from each other to disconnect the first and second connector subs from each other and thereby disconnect the first and second portions of the downhole tool string from each other.

5. The apparatus of claim 4 wherein the fastener contains an explosive charge selectively operable to detonate to sever the fastener and thereby disconnect the first and second fastener portions from each other.

6. The apparatus of claim 4 wherein the second fastener portion is latched against a shoulder of the second connector sub, and wherein the second fastener portion is movable within the internal chamber when the first and second fastener portions are disconnected from each other.

7. The apparatus of claim 4 wherein, while the downhole tool is conveyed within the wellbore, a port permits wellbore fluid to flow into the first chamber portion from the wellbore thereby forming a pressure differential between pressure within the first chamber portion and pressure within the second chamber portion, and wherein, after the first and second fastener portions are disconnected from each other, the pressure differential facilitates movement of the second fastener portion within the internal chamber to fluidly connect the first chamber portion with the second chamber portion and thereby permit flow of the wellbore fluid from the wellbore into the second chamber portion.

8. The apparatus of claim 1 wherein the first chamber portion is fluidly connected with the space external to the downhole tool via a fluid port, and wherein, while the downhole tool is conveyed within the wellbore:

the fluid port facilitates increasing of pressure within the first chamber portion; and the fastener facilitates maintaining of pressure within the second chamber portion lower than the pressure within the first chamber portion.

9. The apparatus of claim 1 wherein one of the first and second connector subs is at least partially inserted into another of the first and second connector subs, and wherein the downhole tool further comprises a biasing member disposed between the first and second connector subs operable to facilitate separation of the first and second connector subs after the downhole tool is selectively operated to disconnect the first and second connector subs from each other.

10. An apparatus comprising:

a downhole tool for connecting and selectively disconnecting within a wellbore first and second portions of a downhole tool string from each other, wherein the downhole tool comprises:

a first connector sub connectable with the first portion of the downhole tool string;

a second connector sub connectable with the second portion of the downhole tool string, wherein the first and second connector subs at least partially define an internal chamber; and an electrical conductor extending within the first and second connector subs at least partially through a passage extending through a wall of the first and/or second connector sub;

a fastener connecting the first and second connector subs and blocking wellbore fluid from entering the internal chamber while the downhole tool is within the wellbore, wherein, while the downhole tool is conveyed within the wellbore, the downhole tool is selectively operable to cause the fastener to separate into first and second fastener portions to permit the wellbore fluid to enter the internal chamber thereby disconnecting the first and second connector subs and thereby disconnect the first and second portions of the downhole tool string from each other.

11. The apparatus of claim 10 wherein the passage extends alongside the fastener.

12. The apparatus of claim 10 wherein the passage does not extend through the fastener.

13. The apparatus of claim 10 wherein the fastener contains an explosive charge selectively operable to detonate to separate the fastener into the first and second fastener portions.

14. The apparatus of claim 10 wherein the second fastener portion is latched against a shoulder of the second connector sub, and wherein the second fastener portion is movable within the internal chamber when the first and second fastener portions are separated from each other.

15. The apparatus of claim 10 wherein, while the downhole tool is conveyed within the wellbore and after the first and second fastener portions are separated from each other, pressure of the wellbore fluid facilitates movement of the second fastener portion within the internal chamber to permit flow of the wellbore fluid from the wellbore into the internal chamber.

16. The apparatus of claim 10 wherein the downhole tool comprises a fluid port, wherein the fastener blocks the wellbore fluid from entering the internal chamber via the fluid port, and wherein, while the downhole tool is conveyed within the wellbore, the fastener maintains pressure within the internal chamber lower than pressure of the wellbore fluid.

17. An apparatus comprising:

a downhole tool for connecting and selectively disconnecting within a wellbore first and second portions of a downhole tool string from each other, wherein the downhole tool comprises:

a first connector sub connectable with the first portion of the downhole tool string;

a second connector sub connectable with the second portion of the downhole tool string, wherein one of the first and second connector subs is at least partially inserted into another of the first and second connector subs, and wherein the first and second connector subs at least partially define an internal chamber;

a fastener connecting the first and second connector subs and blocking wellbore fluid from entering the internal chamber while the downhole tool is within the wellbore, wherein, while the downhole tool is within the wellbore, the fastener is selectively operable to disconnect the first and second fastener portions from each other and permit the wellbore fluid to enter the internal chamber to thereby disconnect the first and second connector subs from each other; and a biasing member disposed between the first and second connector subs operable to separate the first and second connector subs and thereby separate the first and second portions of the downhole tool string from each other after the first and second connector subs are disconnected from each other.

18. The apparatus of claim 17 wherein the biasing member is compressed between the first and second connector subs thereby biasing the first and second connector subs toward a separated position.

19. The apparatus of claim 17 wherein the first connector sub comprises a first radially extending shoulder, wherein the second connector sub comprises a second radially extending shoulder, and wherein the biasing member is disposed between the first and second radially extending shoulders.

20. The apparatus of claim 17 wherein the biasing member is or comprises a spring.

* * * * *